US011499287B2

(12) United States Patent
Melenbrink et al.

(10) Patent No.: US 11,499,287 B2
(45) Date of Patent: Nov. 15, 2022

(54) SELF-CONTAINED SOIL STABILIZATION SYSTEM

(71) Applicant: President and Fellows of Harvard College, Cambridge, MA (US)

(72) Inventors: Eric Nathaniel Melenbrink, Cambridge, MA (US); Justin Keith Werfel, Cambridge, MA (US)

(73) Assignee: President and Fellows of Harvard College, Cambridge, MA (US)

( * ) Notice: Subject to any disclaimer, the term of this patent is extended or adjusted under 35 U.S.C. 154(b) by 0 days.

(21) Appl. No.: 17/415,483

(22) PCT Filed: Dec. 20, 2019

(86) PCT No.: PCT/US2019/067899
§ 371 (c)(1),
(2) Date: Jun. 17, 2021

(87) PCT Pub. No.: WO2020/132472
PCT Pub. Date: Jun. 25, 2020

(65) Prior Publication Data

US 2022/0074159 A1 Mar. 10, 2022

Related U.S. Application Data

(60) Provisional application No. 62/783,523, filed on Dec. 21, 2018.

(51) Int. Cl.
*E02D 7/16* (2006.01)
*E02D 7/10* (2006.01)
(Continued)

(52) U.S. Cl.
CPC ..... *E02D 7/16* (2013.01); *E02D 3/00* (2013.01); *E02D 7/10* (2013.01); *E02D 7/18* (2013.01)

(58) Field of Classification Search
CPC ..... E02D 7/02; E02D 7/10; E02D 7/18
See application file for complete search history.

(56) References Cited

U.S. PATENT DOCUMENTS 4,050,526 A 9/1977 Deike
4,147,457 A 4/1979 Washida
(Continued)

FOREIGN PATENT DOCUMENTS

CN 106703031 A * 5/2017
CN 111622220 A * 9/2020 ..... E02D 13/04
(Continued)

OTHER PUBLICATIONS

International Search Report and Written Opinion dated May 7, 2020 in connection with International Application No. PCT/US2019/067899.

(Continued)

*Primary Examiner* — Frederick L Lagman
(74) *Attorney, Agent, or Firm* — Wolf, Greenfield & Sacks, P.C.

(57) ABSTRACT

A self-contained soil stabilization system may include a chassis, at least one motor coupled to the chassis configured to actuate a locomotor configured to move the chassis, and a hopper disposed on the chassis and configured to contain a payload configured to stabilize soil. The payload may be deployed from the hopper to stabilize soil in a target soil stabilization area. In some embodiments, the payload may be a chemical soil stabilization agent, a pile, or a sheet pile.

17 Claims, 22 Drawing Sheets

(51) Int. Cl.
*E02D 7/18* (2006.01)
*E02D 3/00* (2006.01)

(56) References Cited

U.S. PATENT DOCUMENTS

| | | | |
|---|---|---|---|
| 4,703,811 | A | 11/1987 | Lam |
| 5,570,975 | A | 11/1996 | Reinert, Sr. |
| 6,193,437 | B1 | 2/2001 | Heims |
| 2011/0164928 | A1 | 7/2011 | Homsi |

FOREIGN PATENT DOCUMENTS

| | | | | |
|---|---|---|---|---|
| CN | 112502146 | A | * | 3/2021 |
| JP | 2007-040059 | A | | 2/2007 |

OTHER PUBLICATIONS

International Preliminary Report on Patentability dated Jul. 1, 2021 in connection with International Application No. PCT/US2019/067899.

[No Author Listed], Romu: A Robot for Environmental Protection. Harvard University. Apr. 8, 2019. 1 page. URL:https://www.youtube.com/watch?time_continue=6&v=VF6y7BPEw90&feature=emb_logo.

* cited by examiner

SELF-CONTAINED SOIL STABILIZATION SYSTEM

RELATED APPLICATIONS

This application is a U.S. National Stage Application claiming the benefit of International Application No. PCT/US2019/067899, filed Dec. 20, 2019, entitled "Self-Contained Soil Stabilization System," which claims the benefit under 35 U.S.C. § 119(e) of U.S. Provisional Application No. 62/783,523, entitled "SELF CONTAINED SOIL STABILIZATION SYSTEM", filed Dec. 21, 2018, the entire contents of each of which is incorporated herein by reference.

BACKGROUND

Soil stabilization is a process which is commonly carried out where soil is not stable for ecological (e.g., erosion) or construction (e.g., foundations) purposes. Pile driving, the task of sinking posts or similar building elements into the ground, is a commonly used technique for soil stabilization for ecological management or construction projects. Conventionally, piles may provide foundation support, facilitate construction on steep slopes, hold back soil during excavations, or generally increase stability where surface soil is not stable. Traditional methods of pile driving include driving the piles into the ground with heavy-duty machinery and skilled human workers. In some cases, it may be sufficient to employ chemical stabilizers which are manually spread over a region and react with components of the soil to increase soil stability.

SUMMARY

According to some embodiments, a self-contained soil stabilization system includes a chassis, at least one motor coupled to the chassis and configured to actuate a locomotor configured to move the chassis, a hopper disposed on the chassis and configured to contain a payload configured to stabilize soil, and a controller configured to transmit a hopper command to cause a portion of the payload to be deployed.

According to some embodiments, a pile driving system includes a chassis, at least one locomotor configured to locomote the chassis along a ground surface and at least one motor coupled to the chassis and the at least one locomotor. The at least one motor is configured to actuate the at least one locomotor to locomote the chassis along the ground surface. The pile driving system also includes a hopper disposed on the chassis and configured to contain one or more piles, a controller configured to transmit a hopper command to the hopper to cause at least one of the one or more piles to be deployed, and a gripper configured to retrieve the at least one pile from the hopper upon receipt of the hopper command. The hopper is further configured to release at least one of the one or more piles in response to receiving the hopper command.

According to some embodiments, a self-contained soil stabilization system includes a chassis, at least one wheel configured to support the chassis on a ground surface and to allow for locomotion of the chassis along the ground surface, an independent suspension element operatively coupled to the at least one wheel to the chassis and configured to selectively adjust a distance between the at least one wheel and the chassis upon receipt of a suspension command, and at least one motor coupled to the chassis and the at least one wheel. The at least one motor is configured to actuate the at least one wheel to move the chassis along the ground surface. The self-contained soil stabilization system also includes a hopper disposed on the chassis and configured to contain a payload for stabilizing soil, and a controller configured to transmit a suspension command to adjust the distance between the at least one wheel and the chassis and transmit a hopper command to cause a portion of the payload to be deployed. The hopper is configured to deploy at least a portion of the payload in response to receiving the hopper command.

According to some embodiments, a pile driving system includes a chassis and a hopper disposed on the chassis and configured to contain one or more sheet piles. Each of the one or more sheet piles includes a central portion and two side portions extending from the central portion at an incline. The pile driving system also includes a controller configured to transmit a hopper command to the hopper to cause one of the one or more sheet piles to be deployed, a payload gripper configured to grasp the sheet pile from the hopper, and an aligner to align the deployed sheet pile and the previously-driven sheet pile. The hopper is configured to release one of the one or more sheet piles in response to receiving the hopper command.

According to some embodiments, a method for operating a self-contained soil stabilization system includes adjusting a distance between a chassis and at least one wheel of the self-contained soil stabilization system to a first distance, releasing a pile from a hopper disposed on the chassis, grasping the pile with a gripper, and adjusting the distance between the chassis and the at least one wheel to a second distance after the pile is grasped with the gripper. The second distance is less than the first distance. The method also includes vibrating the pile with a vibratory hammer and releasing the pile from the gripper.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
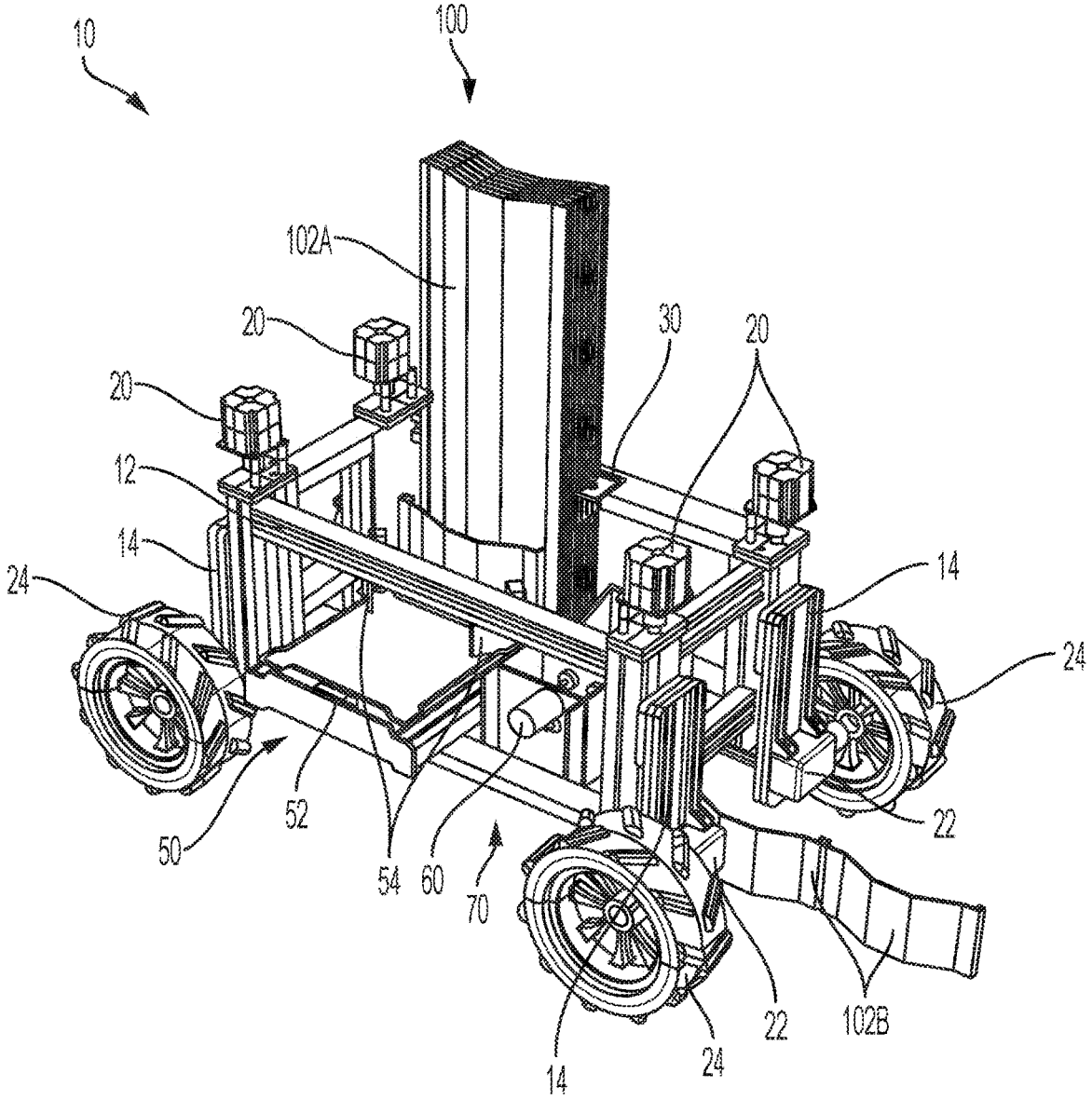
FIG. 1 is a perspective view of one embodiment of a self-contained soil stabilization system and payload.

Some conventional techniques for performing soil stabilization are highly energy intensive and typically require a skilled human worker who operates heavy machinery. For example, stabilizing soil using conventional pile driving or application of chemical binding agents to soil are expensive and time consuming techniques which are generally restricted to large scale construction or ecological projects. Furthermore, progress using such techniques may be limited by the number of skilled workers and amount of heavy machinery available to perform the stabilization. Such heavy machinery is often not optimized for the task. For example, in conventional pile driving equipment, only a small fraction of the weight of the machinery is applied to the primary task of generating downward force (i.e., bias weight), while the majority of the weight of the machine is used to counterbalance the bias weight. Also, as piles are usually only gripped from the top, the machine typically needs to be at least as tall as the pile it's driving. In cases where such resources are scarce, construction projects may be slowed significantly. Additionally, there are many geographical locations where soil stabilization may be beneficial, but the lack of available resources and/or cost inhibits employing conventional soil stabilization techniques. In particular, remote or rural ecological sites (e.g., regions undergoing desertification, beaches, arroyos, post-industrial brownfields, abandoned mining sites, or generally degraded land) susceptible to erosion, flooding, or drought are oftentimes inaccessible or prohibitively expensive for employing traditional methods of soil stabilization.

In view of the above, the inventors have recognized the benefits of a self-contained soil stabilization system which may autonomously perform one or more soil stabilization tasks. The self-contained soil stabilization system may include a hopper configured to hold and allow for the dispensing of a payload which stabilizes soil (e.g., piles, chemical stabilizers, etc.). The self-contained soil stabilization system may also include a locomotive system configured to move the system to various sites where soil stabilization is beneficial. Such an arrangement may allow soil-stabilization to be performed in construction sites and/or remote areas without significant human on-site supervision.

In some embodiments, a self-contained soil stabilization system includes a chassis and at least one motor coupled to the chassis and configured to actuate a locomotor configured to move the chassis. The chassis and locomotor may serve as a base system for carrying a variety of different payloads for soil stabilization. The locomotor may include wheels, tracks, legs or any other suitable locomotive element for moving the chassis in a soil stabilization target site. A hopper may be mounted to the chassis and configured to contain the payload configured to stabilize soil. The hopper may be configured to hold one or more distant payloads for soil stabilization, including, but not limited to, piles, sheet piles, and chemical soil stabilizers. The soil stabilization system may also include a controller configured to transmit a command to the hopper and/or other components to deploy the payload. The payload may be deployed directly from the hopper (e.g., by opening a valve or door) or may be extracted from the hopper (e.g., by a payload gripper). In some embodiments, the controller may also be configured to control the at least one motor to navigate the soil stabilization system around or to a target soil stabilization site. Accordingly, the self-contained soil stabilization may include one or more sensors configured to provide a location signal to the controller indicative of a location of the soil stabilization system, such as a GPS, LIDAR, optical sensor, inertial measurement unit (IMU), or any other suitable sensor. In some embodiments, the controller may receive input from a remote controller for controlling the soil stabilization system, such as a remote server, handheld controller, or other suitable device.

According to exemplary embodiments described herein, a self-contained soil stabilization system may deploy one or more payloads to a target soil stabilization site which increases soil stability at the target site. In some embodiments, the payload may include plurality of piles carried by the soil stabilization system. For example, the soil stabilization system may carry cylindrical piles, sheet piles, tubular piles, H-piles, or any other suitable type of pile. The piles may be dispensed from a hopper onboard the soil stabilization system, such that one or more of the piles may be deployed at the target soil stabilization site. In some embodiments, the payload may include a chemical soil stabilization agent, including, but not limited to magnesium chloride, polyurethane, sodium silicate, polymers (e.g., biopolymers, co-polymer based products, cross-linking styrene acrylic polymers, etc.), ionic stabilizers, calcium chloride, calcite, tree resins, bitumen, fly ash, cement, cyanobacteria, or any other suitable chemical or biological stabilizer. In some embodiments, chemical stabilizers may be deployed in combination with one or more piles. Any suitable soil stabilization payload may be deployed, as the present disclosure is not so limited.

In some embodiments of a self-contained soil stabilization system, the system may be constructed and arranged as a pile driving system. The pile driving system may include a chassis, a hopper for carrying one or more piles to be deployed, and one or more wheels linked to the chassis by an independent suspension element. The independent suspension element may be used to adjust the distance between the one or more wheels and the chassis. The pile driving system may also include a payload gripper configured to grasp and deploy a pile from a hopper of the pile driving system to deploy the one or more piles. When a pile is deployed from the hopper (e.g., extracted from the hopper by a payload gripper), the pile may be placed against soil to be stabilized. The independent suspension may have previously increased the distance between the one or more wheels and the chassis, such that a driving gripper (which, in some embodiments, may be the same device as the payload gripper) grips the deployed pile a non-zero distance above the soil to be stabilized. Once the driving gripper has gripped the deployed pile, the independent suspension element may reduce the distance between the wheels and the chassis, thereby redistributing at least a portion of the weight of the soil stabilization system from the wheels onto the deployed pile. Any amount of the weight of the soil stabilization system applied to the deployed pile contributes to the task of driving the deployed pile into the soil. In some embodiments, the pile driving system includes a hammer (e.g., vibratory hammer) which assists driving the pile into the soil while some portion of the weight of the pile driving system is supported by or suspended from the deployed pile.

In some embodiments, the driving gripper may release the pile when the pile is driven and the distance between the soil and the pile driving system is reduced to a point where no portion of the weight of the pile driving system is supported by the pile and/or when the pile is driven to a suitable depth. In some embodiments, the point where no portion of the weight of the pile driving system is supported by the pile may correspond to a point where the one or more wheels come into contact with the soil. Of course, in other embodiments, the pile driving system may remain in constant contact with the underlying soil as a pile is driven, as the present disclosure is not so limited. If the deployed pile is sufficiently driven, the pile driving system may move on to another target soil stabilization location. Alternatively, in some embodiments, the independent suspension system may increase the distance between the wheels and the chassis, raising the chassis relative to the soil. Once the chassis is raised, the driving gripper may regrasp the deployed pile and the independent suspension element may reduce the distance between the one or more wheels and the chassis to distribute the weight of the pile driving system to the deployed pile a second time. The deployed pile may be repeatedly driven by repeating this process until the deployed pile is sufficiently driven.

In some cases, it may be desirable to deploy numerous sheet piles in a line to improve soil stabilization along a continuous region. For example, such soil stabilization may be desirable to form a check dam or other similar structure for erosion control and promoting groundwater recharge. In such cases, it may be desirable to align a previously-deployed sheet pile and a newly-deployed sheet pile such that a continuous line of piles is formed. In some embodiments, a sheet pile may include an interlocking slot on either transverse side of the sheet pile. According to this embodiment, it may be desirable to reliably align the interlocking slots of a previously-deployed sheet pile (e.g., a sheet pile that has already been driven into the soil) and a newly-deployed sheet pile (e.g., a sheet pile that will be driven into the soil next to the previously-deployed sheet pile). In some embodiments, a pile driving system may include an aligner configured to align the pile driving system relative to a previously-deployed sheet pile such that a newly-deployed sheet pile is deployed with the interlocking slots of the sheet piles are aligned. The aligner may be an active component (e.g., a gripper) or a passive component (e.g., a 2D or 3D alignment slot) which is shaped to complement the shape of the sheet piles. The aligner may grasp a previously-deployed sheet pile to move the pile driving system so that at least one axis of the pile driving system (e.g., longitudinal axis, transverse axis etc.) is aligned with at least one axis of the sheet piles (e.g., transverse axis, thickness axis). The aligner may also move the pile driving system to a predetermined location relative to the pile so that the newly-deployed pile is consistently deployed to the same position relative to the previously-deployed pile.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 is a perspective view of one embodiment of a self-contained soil stabilization system 10 and payload 100. According to the embodiment shown in FIG. 1, the self-contained soil stabilization system is configured as a pile driving system configured to carry a payload of sheet piles 102A. As shown in FIG. 1, the pile driving system includes a chassis 12 which is supported by four wheels 24, two of which are actuated by locomotion motors 22 operatively coupled to the wheels. The wheels are coupled to the chassis via independent suspension elements 14 which are linked individually to linear actuators 20. The linear actuators 20 are configured to control the height of the chassis relative to the wheels independently for each wheel. Although electromechanical linear actuators are shown in FIG. 1, any suitable actuator may alternatively be employed, including, but not limited to, hydraulic actuators, pneumatic actuators or any other suitable actuator. The pile driving system also includes a hopper 30 which carries a plurality of sheet piles 102A which are deployable to a target soil stabilization site. The pile driving system also includes a payload gripper 50 configured to extract the sheet piles from the hopper (e.g., when the payload gripper receives a hopper command from a controller) by grasping the deployed sheet pile on either side with jaws 54. The pile driving system also includes a vibratory hammer 60 configured to vibrate the pile driving system to assist with driving the deployed piles. According to the embodiment of FIG. 1, the pile driving system includes an aligner 70 configured as an alignment gripper configured to align the pile driving system with one or more previously-deployed sheet piles 102B. In the depicted embodiment, the alignment gripper also is configured as a driving gripper, and may be controlled to grasp a deployed sheet pile as it is driven into soil. In other embodiments, the pile driving system may include an aligner and driving gripper as separate components disposed on the chassis, or the payload gripper could be configured as a driving gripper, as the present disclosure is not so limited.

According to the embodiment shown in FIG. 1, the self-contained soil stabilization system 10 may include a power source and a controller (not shown in the figure). The power source may be configured to supply power to one or more actuators and sensors of the self-contained soil stabilization system (e.g., linear actuators 20, locomotion motors 22, payload gripper 50, vibratory hammer 60, etc.). The power source may be one or more of a rechargeable battery, renewable energy source (e.g., solar panel), internal combustion engine, fuel cell, or any other suitable power source. The controller may be configured to control power delivery and/or direct the operation of said one or more actuators and sensors to operate the self-contained soil stabilization system. That is, the controller may be configured to transmit one or more commands to one or more components of the soil stabilization system. For example, the controller may transmit a hopper command to the payload gripper 50 so that the payload gripper grasps and deploys a sheet pile from the hopper, as discussed in more detail below with reference to FIGS. 2-3. As another example, the controller may transmit a locomotion command to the locomotion motors 22 to move the soil stabilization system along a ground surface and/or transmit a suspension command to the linear actuators 20 to adjust the distance between wheels 24 and the chassis 12.

Figure 2:
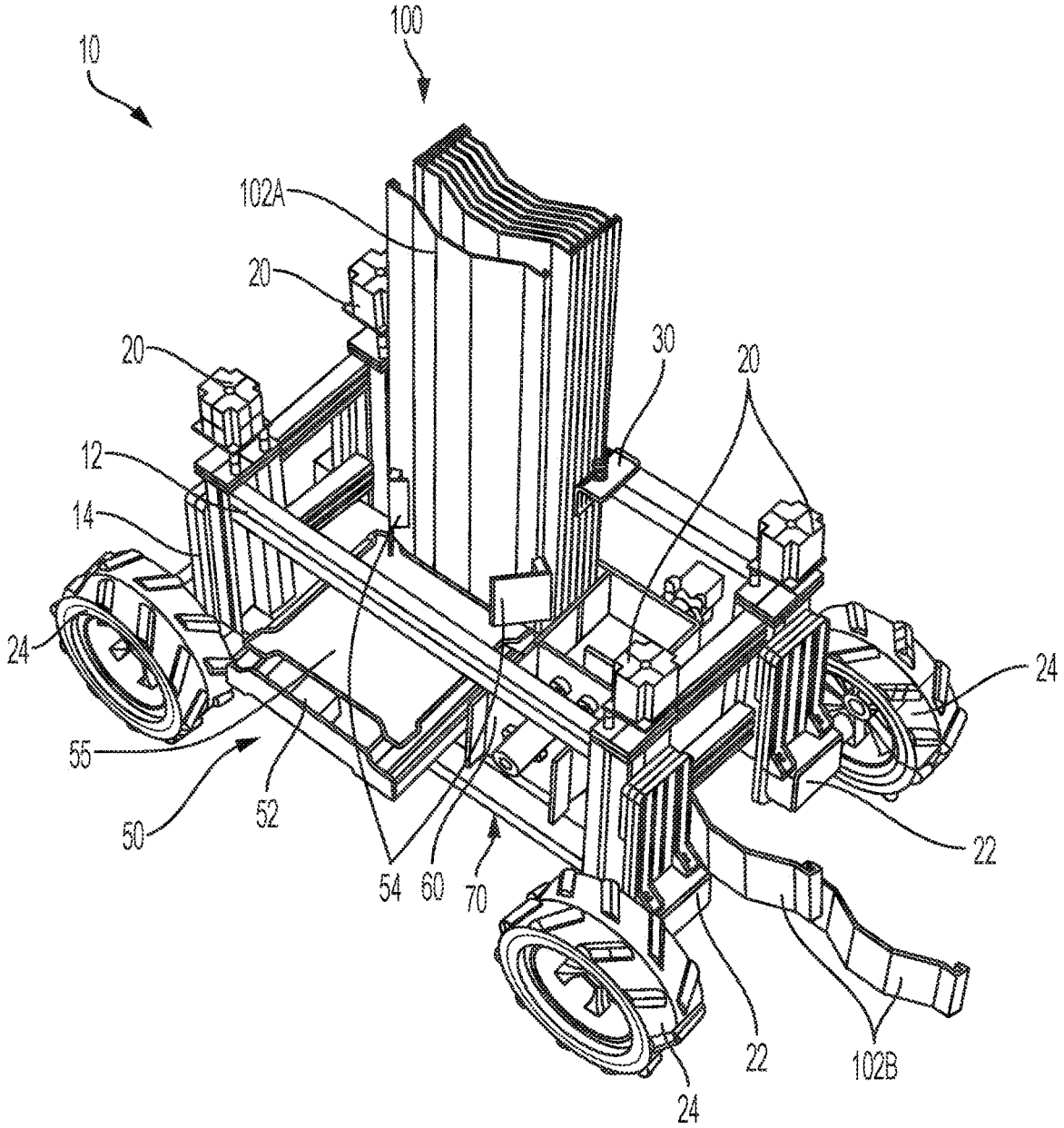
FIG. 2 is a perspective view of the self-contained soil stabilization system of FIG. 1 during a payload deployment process.
Figure 3:
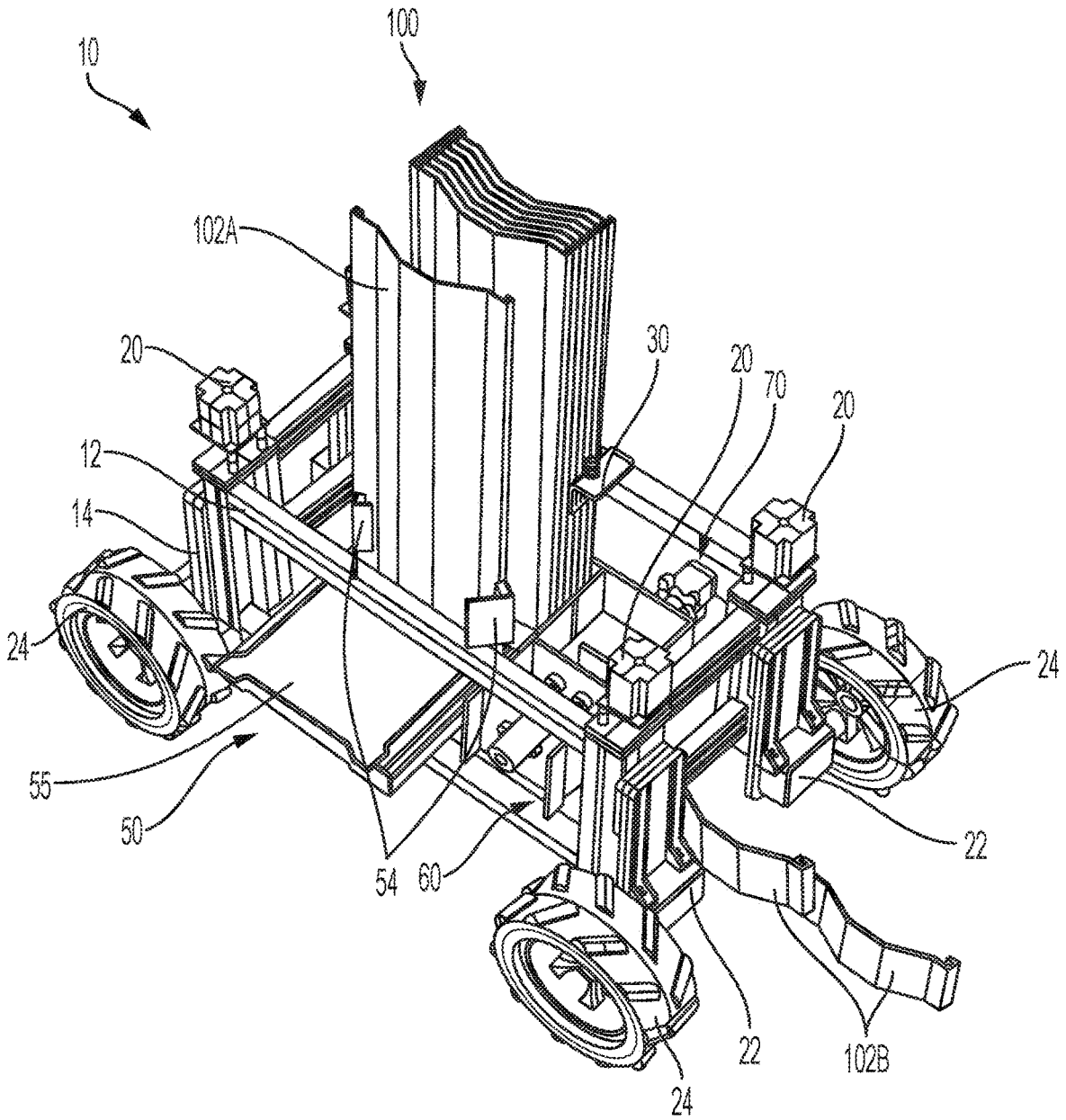
FIG. 3 is a perspective view of the self-contained soil stabilization system of FIG. 1 during a payload deployment process.

FIG. 2 is a perspective view of the self-contained soil stabilization system 10 of FIG. 1 during a payload deployment process. As shown in FIG. 2, a sheet pile 102A is being deployed from the hopper 30. The payload gripper 50 is used to remove the sheet pile 102A from the hopper. More specifically, two jaws 54 coupled to a payload gripper actuator 52 may grasp the sheet pile along the sides of the sheet pile. According to the embodiment shown in FIG. 2, the jaws 54 are coupled to a payload gripper base 55. The payload gripper actuator moves the payload gripper base in a direction toward and away from the stacked sheet piles in the hopper 30, for example, upon receipt of a hopper command from the controller. When the gripper base is moved toward the hopper, the jaws move outward around the innermost sheet pile in the hopper to capture the deployed sheet pile 102A in the jaws so that when the gripper base 55 is retracted away from the hopper the deployed sheet pile is drawn out of the hopper, as shown in FIG. 3. The jaws 54 may be active or passive components mounted to the gripper base 55. For example, the jaws may be flexibly linked to the plate, with the jaws configured to flex out and around an innermost sheet pile. As another example, the jaws may be coupled to one or more actuators which adjust the distance between the jaws so that the deployed sheet pile may be selectively grasped. Of course, while the jaws 54 are shown coupled to a gripper base in the embodiment of FIG. 2, the jaws may be independently movable toward or away from the stacked sheet piles or may be joined with any suitable arrangement which allows the payload gripper to grasp a pile from the hopper, as the present disclosure is not so limited. In some embodiments, the payload gripper may be included as a part of the hopper 30. For example, an actuable latch (e.g., solenoid) may be used to dispense a single sheet pile from the payload upon receipt of a hopper command from a controller. Any suitable hopper and/or payload gripper may be used to deploy a payload from the self-contained soil stabilization system, as the present disclosure is not so limited.

FIG. 3 shows the self-contained soil stabilization system of FIG. 1 as a sheet pile 102A is deployed from the hopper 30. As shown in FIG. 3, the payload gripper base 55 has been moved away from the hopper 30. The innermost sheet pile 102A has been grasped by the jaws 54 of the payload gripper and the payload gripper base has moved away from the hopper so that the deployed sheet pile is separated from the remainder of the sheet piles still in the payload 100. From the position shown in FIG. 3, the controller may command the extracting gripper (e.g., with a hopper command or release command) to release the deployed sheet pile 102A, which may or may not involve the payload gripper using its jaws to grasp and remove a pile from the hopper, such that the deployed sheet pile drops to the soil and interlocks with any previously-deployed sheet piles 102B. Before the deployed sheet pile is dropped, the self-contained soil stabilization system may ensure alignment between the deployed sheet pile and a previously-deployed sheet pile, such that the sheet pile may interlock with the previously-deployed sheet pile, as discussed in more detail below with reference to FIGS. 10-22. In the embodiment shown in FIG. 3, the payload gripper is configured to release the deployed sheet pile to the underlying soil. The controller is configured to transmit a command to the locomotion motors 22 to move the self-contained soil stabilization system forward so that the deployed pile can be grasped in the aligner 70 to which the vibratory hammer 60 is coupled. In such an embodiment, the aligner is configured as a driving gripper which is used to drive the deployed sheet pile into the underlying soil. In other embodiments, the vibratory hammer may be coupled to the payload gripper so that the payload gripper is configured as a driving gripper. In such an embodiment, the payload gripper may regrasp the deployed pile after the deployed pile is released and the regrasped pile may be further driven into the soil.

Figure 4:
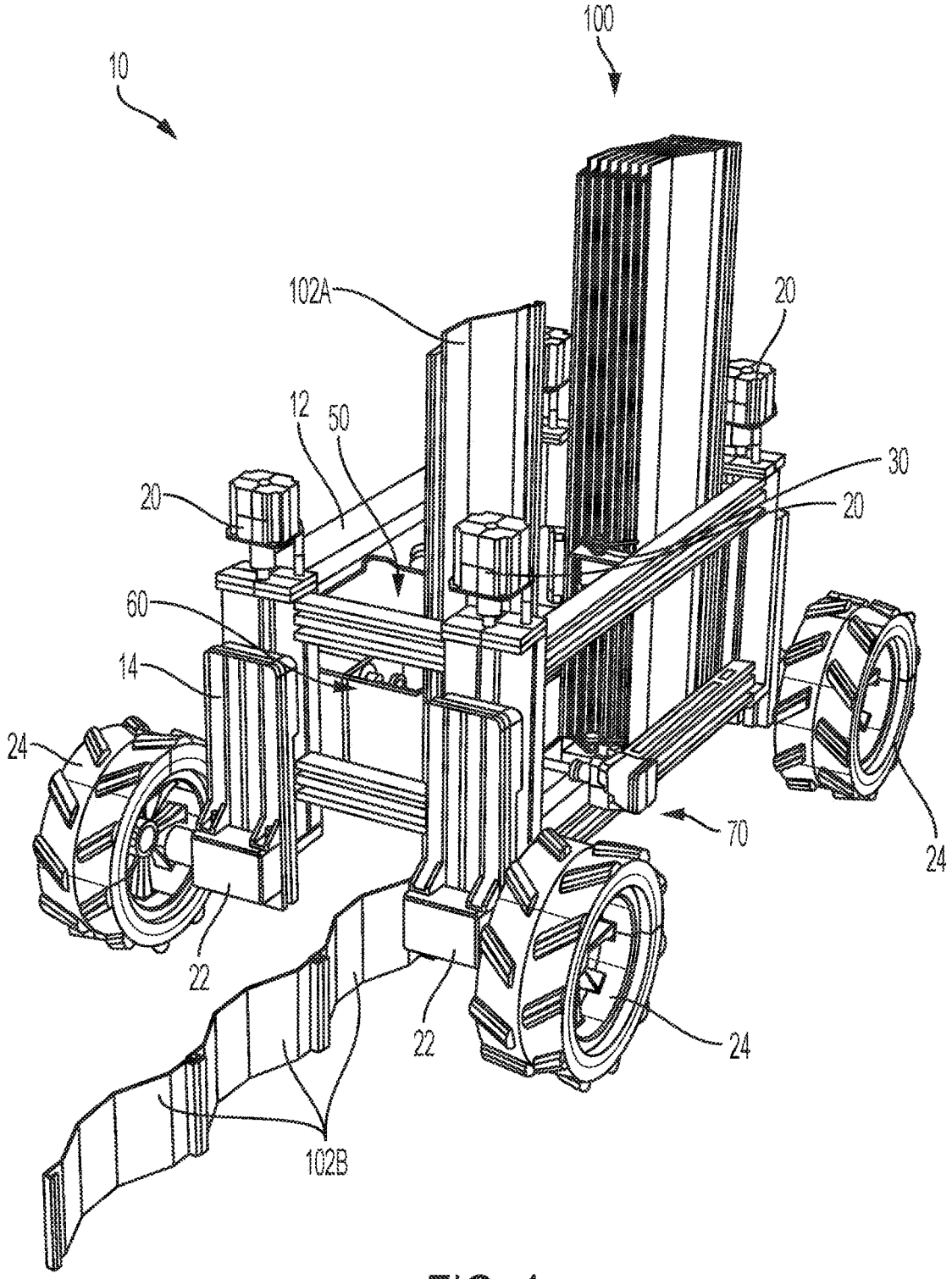
FIG. 4 is a perspective view of the self-contained soil stabilization system of FIG. 1 during a payload deployment process.
Figure 5:
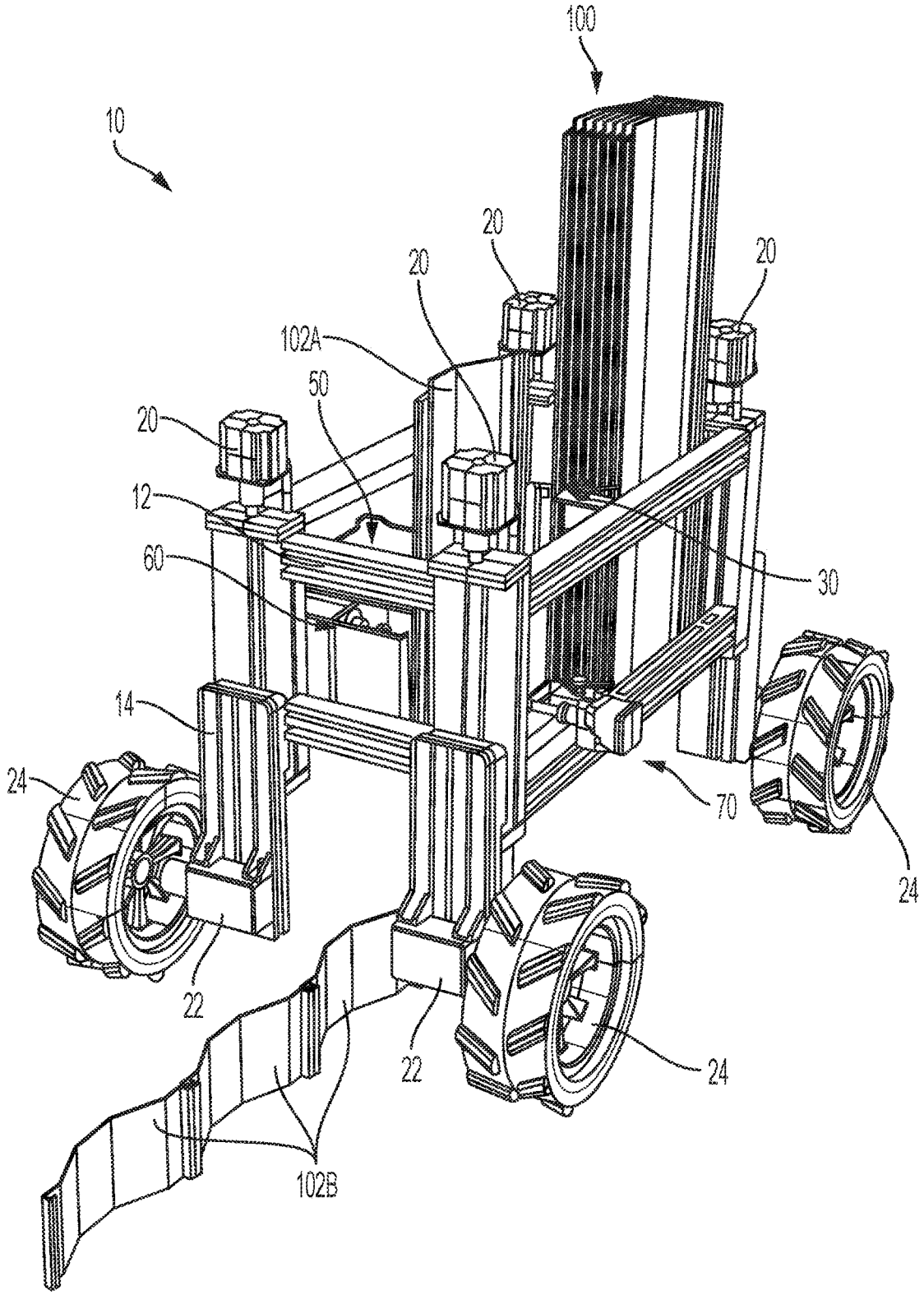
FIG. 5 is a perspective view of the self-contained soil stabilization system of FIG. 1 during a payload deployment process.

FIG. 4 shows a rear perspective view of the self-contained soil stabilization system of FIG. 1 as a deployed sheet pile 102A during a driving process. In the state shown in FIG. 4, the deployed pile 102A has been released by the payload gripper 50 so that the deployed pile is aligned with one or more previously-deployed piles 102B. The deployed pile 102A rests against the underlying soil as the controller transmits a command to the locomotion motors 22 to move the self-contained soil stabilization system forward until the deployed sheet pile is aligned with the aligner 70 which is configured as a driving gripper. Once aligned with the aligner, the independent suspension elements 14 and linear actuators 20 may be used to adjust the height of the chassis relative to the deployed sheet pile, for example, upon receipt of a suspension command from the controller. That is, the linear actuators 20 may increase the vertical distance between the wheels 24 and the chassis 12 to increase the height of the chassis relative to the deployed pile 102A, as shown in FIG. 5. Of course, while the linear actuators are configured to adjust a vertical distance in the embodiment of FIG. 4, the linear actuators may be used to adjust any suitable distance in any suitable direction which results in height change of the self-contained soil stabilization system relative to the deployed pile. For example, if the wheels were coupled to the chassis 12 by a diagonal independent suspension members (i.e., out of angular alignment from a local gravitational direction), adjustment of the diagonal distance may be used to adjust the relative height of the chassis of the self-contained soil stabilization system.

In the state shown in FIG. 5, the linear actuators 20 of the soil stabilization system 10 have vertically moved the wheels 24 away from the chassis 12 so that the chassis is higher relative to the deployed pile 102A and underlying soil. As each of the independent suspension elements 14 includes an individual linear actuator 20, the vertical distance between each of the wheels and the chassis may be individually adjusted. Accordingly, the chassis of the self-contained soil stabilization system may maintain a level orientation relative to a local gravitational direction, even where the local terrain is uneven. Such an arrangement may promote consistent deployment of the payload and any manipulation of the payload (e.g., driving piles). Once the height of the chassis has been adjusted to the position shown in FIG. 5, the aligner 70 (configured as a driving gripper) may be closed around the deployed pile, pressing the deployed pile into the vibratory hammer 60. When the driving gripper has been secured to the deployed pile, the controller may transmit a suspension command to each of the linear actuators to reduce the vertical distance between the wheels and the chassis, thereby distributing some portion of the weight of the self-contained soil stabilization system from the wheels to the pile. As the weight of the self-contained soil stabilization system is at least partially supported by the deployed sheet pile 102A, the vibratory hammer 60 may be activated (e.g., simultaneously), for example, upon receipt of a vibration command from the controller, thereby transmitting vertical vibrations to the deployed pile to assist in driving the pile. Supporting some portion of the weight of the self-contained soil stabilization system may provide sufficient force to move the pile vertically into the underlying soil, for example, without requiring the entirety of the weight of the self-contained soil stabilization system to be supported by the deployed pile or the activation of the vibratory hammer. Of course, while a vibratory hammer is shown employed in the embodiment of FIG. 5, any suitable arrangement may be employed to assist the driving of the deployed pile when the weight of the self-contained soil stabilization system is supported by the deployed pile. Suitable arrangements include, but are not limited to, drop hammers and pneumatic hammers.

In some cases, when the pile is driven for the first time, the pile may not be fully driven to a desirable depth. In such cases, it may be desirable to repeat the driving process by grasping another region of the deployed pile which is higher than the originally grasped region. That is, the controller may command the driving gripper (e.g., aligner 70) to release the deployed pile, whereupon the controller transmits a suspension command to the linear actuators 20 to increase the vertical distance between the wheels and the chassis. Once the chassis is in a higher position relative to the deployed pile and a local gravity direction, the controller may command the driving gripper to grasp the deployed pile at a second region higher than a first region. Once the deployed pile is regrasped, the controller may transmit a suspension command to the linear actuators 20 to reduce the vertical distance between the wheels and the chassis, distributing at least some portion of the weight of the self-contained soil stabilization system from the wheels to the deployed pile for a second time. The controller may transmit a vibration command to the vibratory hammer 60 so that vibrations are transmitted to the deployed pile, further driving the deployed pile into the soil. The process may be repeated until the deployed pile has been driven a desired depth into the underlying soil.

Without wishing to be bound by theory, the percentage of the weight of the self-contained soil stabilization system that is supported by the deployed pile is a function of how much force is required for the pile to overcome the resistance of the soil, and the constant speed at which the chassis is lowered. For example, in very loose soil, it may be the case that driving the pile into the soil at the speed governed by the actuators which lower the chassis uses only 40% of the weight of the self-contained soil stabilization system, while firmer soil might use 80% or more. Any remaining portion of the weight of the self-contained soil stabilization system that is not transferred to the pile will be supported by the one or more wheels or other locomotors. In some cases, the resistance of the soil and speed at which the chassis is lowered may result in the self-contained soil stabilization system coming out of contact with the underlying soil. In such a case, 100% of the weight of the self-contained soil stabilization system may be supported from the deployed pile. In some embodiments, the percentage of total soil stabilization system weight supported from the deployed pile may be greater than or equal to about 40%, 50%, 60%, 70%, 80%, 90%, 99%, or any other appropriate percentage. Correspondingly, the percentage of total soil stabilization system weight supported from the deployed pile may be less than 50%, 60%, 70%, 80%, 90%, 95%, 100%, or any other appropriate percentage. Combinations of the above noted ranges are contemplated, including 60% and 80%, 80% and 100%, and 70% and 100%. Of course, the percentage of weight supported from the deployed pile may be any suitable percentage including percentages both greater and less than those noted above.

Figure 6:
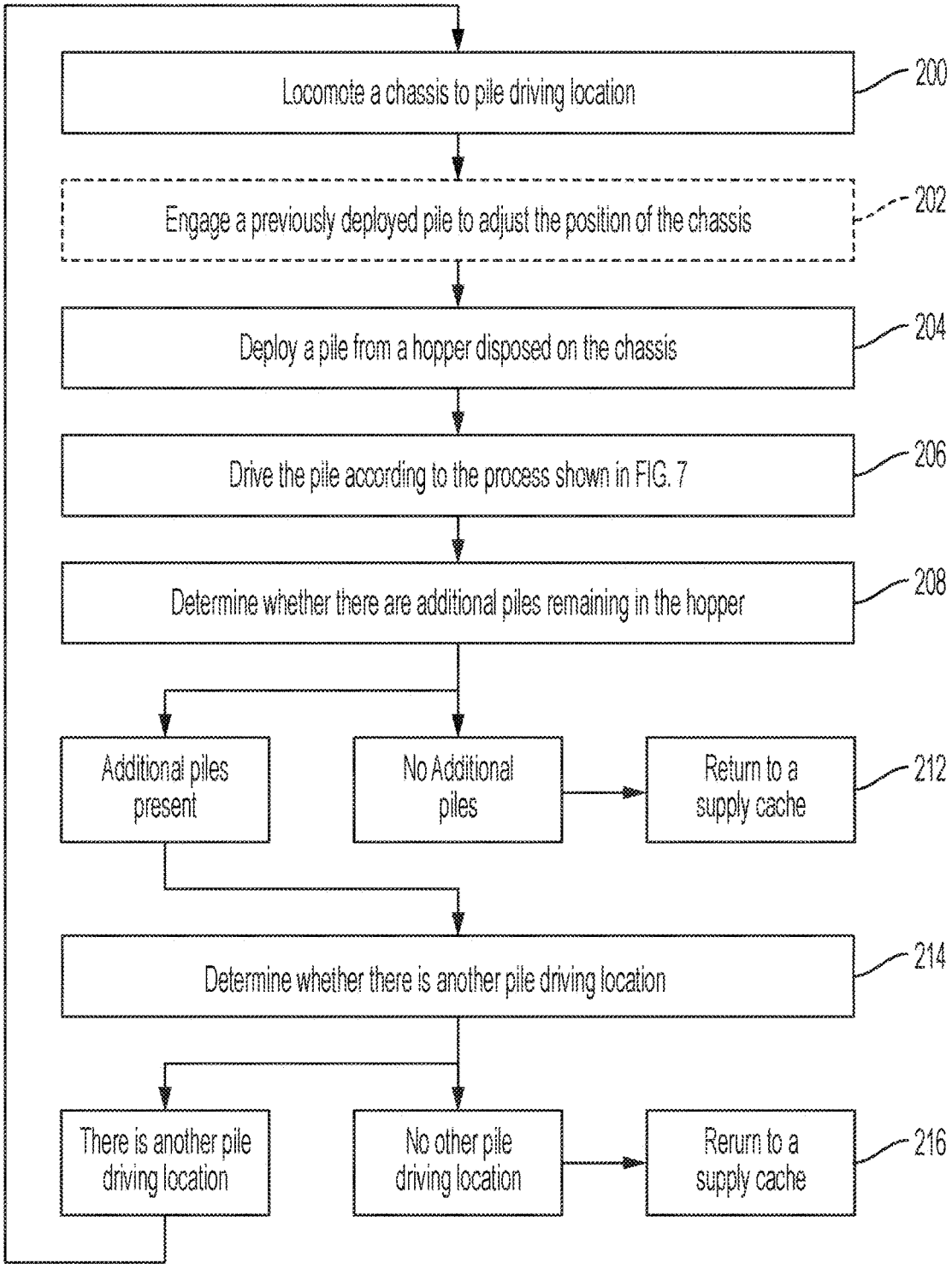
FIG. 6 is a flowchart of a process for operating a self-contained soil stabilization system in accordance with some embodiments.

FIG. 6 is a flowchart of a process for operating a self-contained soil stabilization system to deploy and drive a series of at least one sheet pile in accordance with some embodiments. In act 200, the self-contained soil stabilization system locomotes its chassis to a suitable location for driving a new pile. Depending on whether act 200 is performed as the initiation of a new series of sheet piles or the continuation of an existing series of sheet piles, act 202 is performed. That is, if this is a continuation or extension of an existing series of sheet piles, an aligner is deployed to adjust the position of the chassis relative to a previously deployed pile in act 202. In act 204, a pile is deployed from a hopper disposed on a chassis. The hopper may be deployed by a payload gripper which removes the pile from the hopper, or may be deployed directly by the hopper. The pile may be deployed upon receipt of a hopper command from a controller at one or more actuators responsible for deploying the pile. In act 206, the pile is driven according the sequence described in FIG. 7, repeating as many cycles as necessary to drive the pile to the desired depth. In act 208, the self-contained soil stabilization system (or, in some embodiments, a remote or local operator) determines whether additional piles should be driven by determining whether additional sheet piles are available in the hopper. In the case that the payload has been depleted, the self-contained soil stabilization system returns (e.g., locomotes) to a supply cache in act 212 to refill its payload and could optionally continue on a second deployment. If the payload is not yet depleted, it is determined in act 214 whether there is a suitable location for a next pile to be deployed (e.g. the length of one pile ahead in a continuous series). If there is a suitable pile driving location, the process of FIG. 6 may be repeated. In the case that no suitable location for driving a pile can be determined, the task is deemed complete and the self-contained soil stabilization returns to the supply cache in act 216 to await further instruction.

Figure 7:
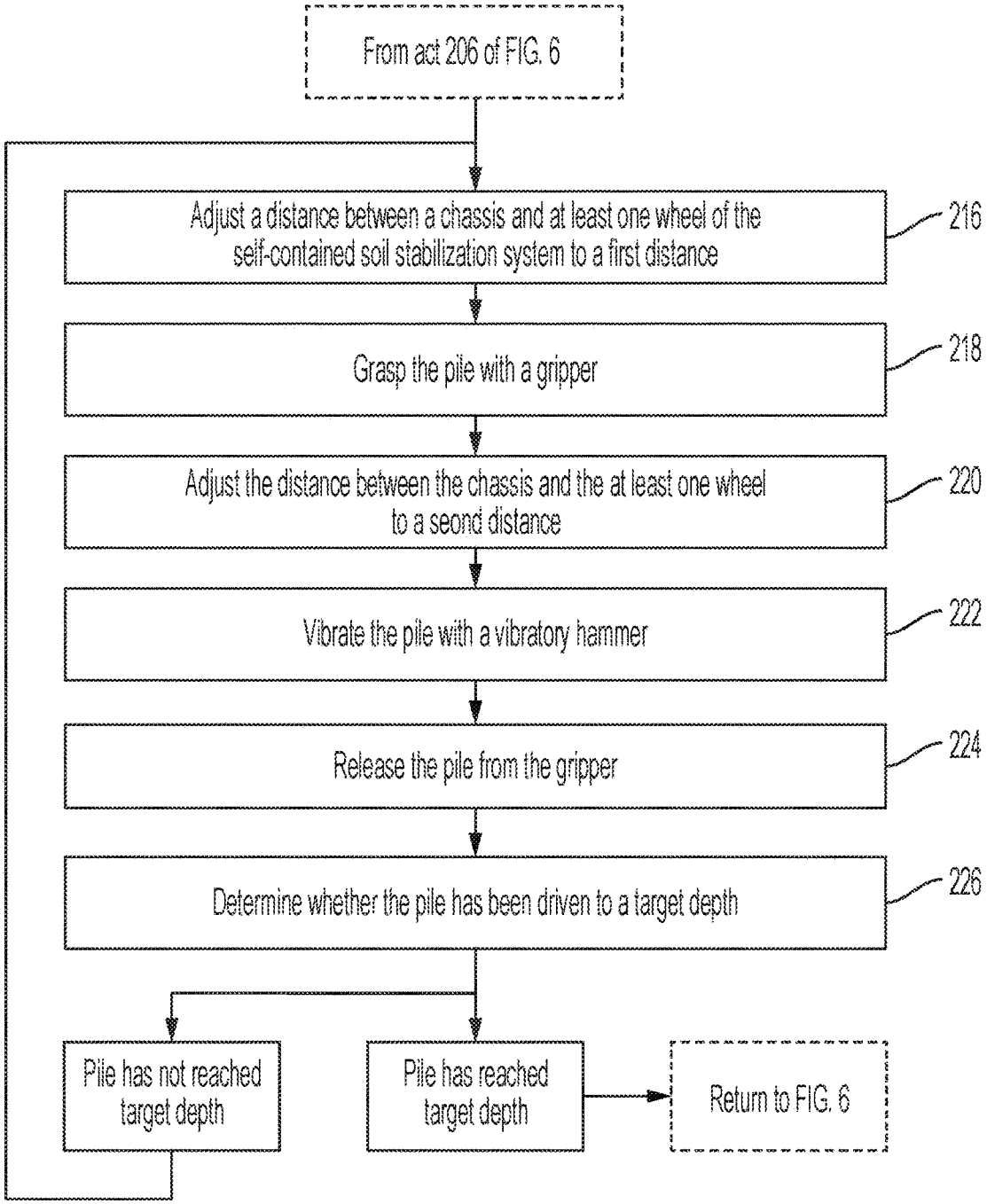
FIG. 7 is a flowchart of a process for operating a self-contained soil stabilization system in accordance with some embodiments.

FIG. 7 illustrates a process for operating a self-contained soil stabilization system to grasp or regrasp and drive a deployed pile in accordance with some embodiments. In act 216, a distance (e.g., a vertical distance) between the chassis and at least one wheel of the self-contained soil stabilization system is adjusted to a first distance. That is, the chassis of the soil stabilization system is lifted relative to the underlying soil and the deployed pile. The first distance may be appropriate for aligning the chassis with previously-deployed piles, for navigating terrain, or for any other suitable function, as the present disclosure is not so limited. In act 218, the pile is either grasped with the gripper for the first time or regrasped in a second region which is gravitationally above the first region which was grasped in a previous cycle. In act 220, the vertical distance between the chassis and at least one wheel is adjusted to the second distance to distribute some portion of the weight from the wheels onto the deployed pile. In act 222, which may be performed simultaneously with act 220, the pile is vibrated with the vibratory hammer to drive the deployed pile into the underlying soil. Once the pile is sufficiently driven and the weight of the self-contained soil stabilization system is once again fully supported by its wheel, the pile is released from the gripper in act 224. In act 226, it is determined whether the pile has been driven to an overall target depth. In the case that the pile has not reached the overall target depth, the process shown in FIG. 7 may be repeated as many times as desirable to drive a deployed pile to a suitable depth. In the case that the pile has reached the overall target depth, the process may return to act 206 of FIG. 6. Various factors may affect the number of drive cycles, including the ultimate desired depth and the predefined intended vertical interval between regrasping, which may be encoded in the form of notches cut into the pile. The first and second distance or any other suitable factor may be modified depending on the amount of driving which is desirable for a given pile, as the present disclosure is not so limited.

Figure 8:
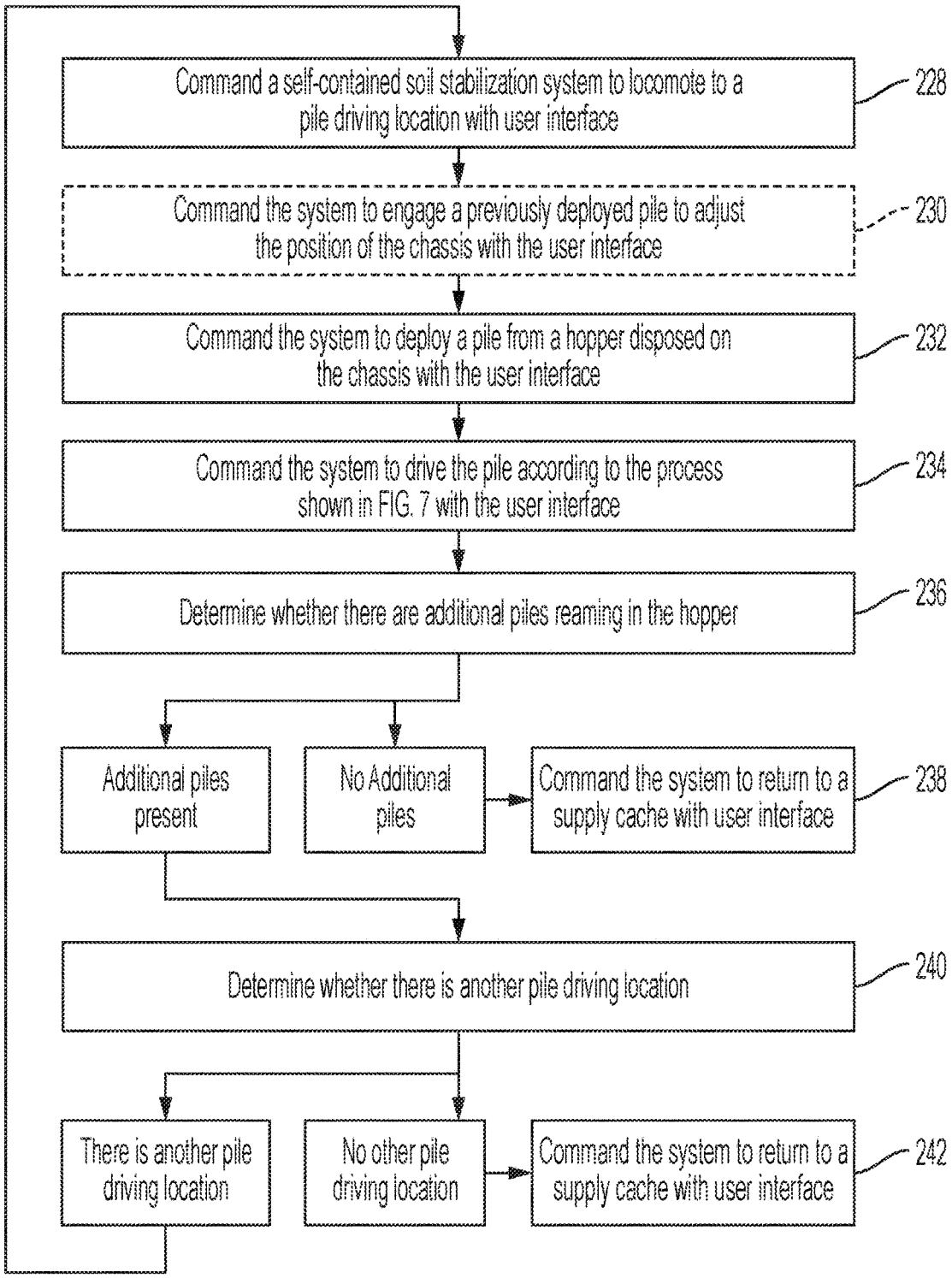
FIG. 8 is a flowchart of a process for operating a self-contained soil stabilization system in accordance with some embodiments.

FIG. 8 illustrates a process for human-assisted operation of a self-contained soil stabilization system. According to the process of FIG. 8, a human may operate a self-contained soil stabilization system of exemplary embodiments described herein. For example, a human may control a soil stabilization system with a user interface, which may be disposed on a handheld controller, portable control panel, remote computer, web server, or any other suitable device which may communicate with the soil-stabilization system via a wired (e.g., serial, Ethernet, etc.) or wireless interface (e.g., satellite, cellular network, 802.15.4 RF, Bluetooth, WiFi, etc.). Accordingly, the human operating the soil stabilization system may be local to the operational site or remote from the operational site. In some embodiments, a human may control multiple self-contained soil stabilization systems simultaneously. This may be achieved by implementing semi-autonomous features or functions of the soil stabilization system so that direct control is not necessary. Additionally, a human controlled soil stabilization system or semi-autonomous system may accomplish all of the tasks of a fully autonomous system. In act 228, the self-contained soil stabilization system is commanded to locomote to a pile driving location with a user interface. In act 230, the soil stabilization system is optionally commanded to engage a previously deployed pile to adjust the position of the chassis of the soil stabilization system. In act 232, the soil stabilization system is commanded to deploy a pile from a hopper disposed on the chassis of the soil stabilization system. In act 234, the soil stabilization system is commanded to drive the pile in accordance with the process of FIG. 7. In act 236, it may be determined by the human operator whether there are additional piles to drive. In the case that there are not additional piles, the soil stabilization system may be commanded to return to a supply cache in act 238. In the case that there are additional piles in the hopper, the human operator may determine whether there is another pile driving location. In the case there is, the process of FIG. 8 may be repeated. In the case that there is not another location, the soil stabilization system may be commanded to return to the supply cache in act 242. Any of the acts shown in FIG. 8 may be automated or semi-automated, as the present disclosure is not so limited.

Figure 9:
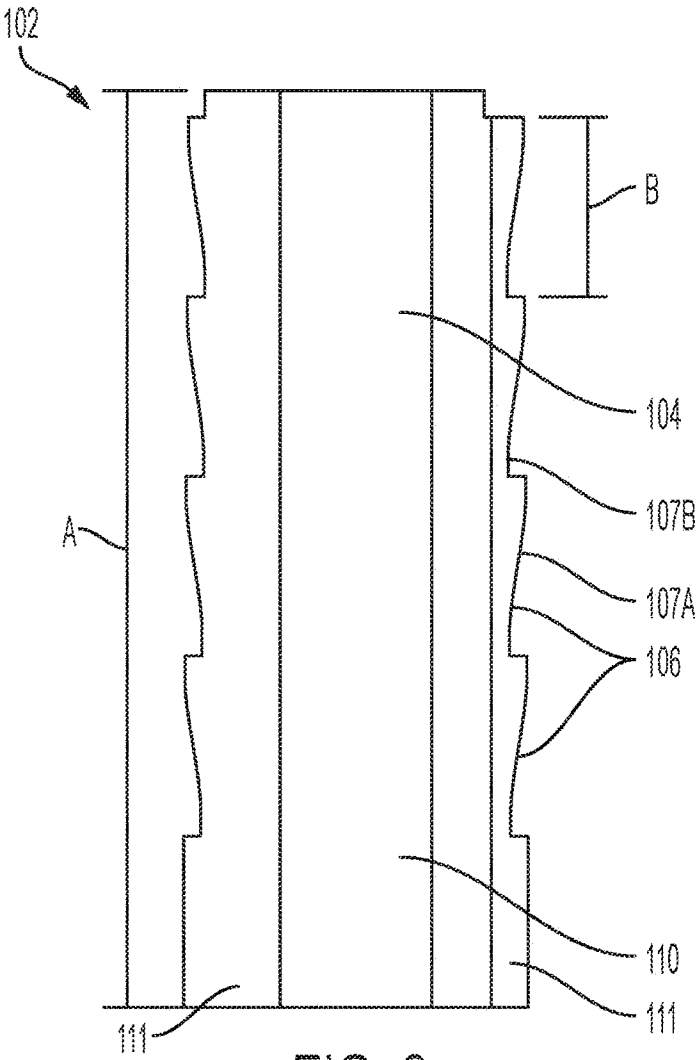
FIG. 9 is a front elevation view of one embodiment of a sheet pile.

FIG. 9 shows a front elevation view of a sheet pile 102 which may be employed as a payload for a soil stabilization system in accordance with some embodiments. As shown in FIG. 9, the sheet pile includes a body 104 and a plurality of notches 106 disposed on either transverse side of the body. The body includes a central portion 110 and two side portions 111 which are angled relative to the central portion (for example, see FIGS. 10-11). The sheet pile has an overall longitudinal length A which may be selected based on a particular soil stabilization target site. In some embodiments, the bottom of the pile is tapered to a point to facilitate soil penetration. Without wishing to be bound by theory, the piles may offer additional soil stability based on the depth of driving. Accordingly, the overall length of the pile may at least partly determine how deeply the pile can be driven which affects the soil stability provided in the target site. Other factors may be considered when selecting an appropriate longitudinal length A, including soil compaction, hydration, pile thickness, and payload capacity of the soil stabilization, among other suitable factors. As shown in FIG. 9, the notches 106 each have a notch length B. The notches and the notch length B may be configured to assist a gripper in grasping the sheet pile. As shown in FIG. 9, the notches are configured to assist a gripper grasping the sheet pile along the transverse sides. The notches include an inclined side 107A and a catch 107B. The catch 107B assists a gripper in transmitting force toward a bottom portion of the pile (i.e., in a driving direction) and may be angled upward to ensure the gripper jaws 54 are not able to slip off of the catch during driving. The inclined side increases the range of tolerance, such that the jaws 54 can successfully grip the pile even if their vertical position is somehow offset slightly from its intended position. In some embodiments, when a gripper releases the sheet pile but will regrasp to continue driving, the gripper may stay in contact with the sheet pile as the gripper is moved up the transverse sides of the sheet pile, sliding over the inclined sides 107A. Alternatively, the gripper may be loosened such that it forms a cage around the pile without touching it directly. Once the gripper is moved past an inclined side, the gripper is commanded to close into a catch 107B and may be used to apply a driving force to the pile. Accordingly, the sheet pile of FIG. 9 may be driven in increments or multiples of the notch length B.

Figure 10:
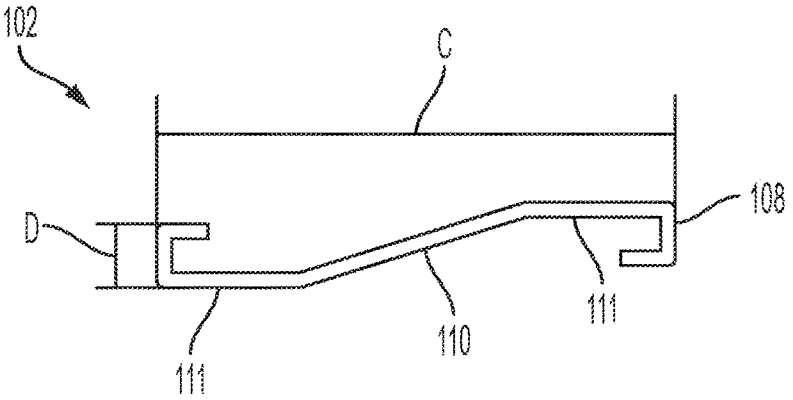
FIG. 10 is a top plan view of the sheet pile of FIG. 9.

FIG. 10 is a top plan view of the sheet pile 102 of FIG. 9. As shown in FIG. 10, the side portions 111 are angled relative to the central portion 110. In the embodiment of FIG. 10, the side portions are parallel to one another. Each end of the of the side portions 111 includes an interlocking slot 108. The interlocking slots are configured to allow the sheet piles to be interlocked with one another in a line along the transverse axis of the sheet pile. As shown in FIG. 10, the sheet pile has a transverse width C and a thickness D. Without wishing to be bound by theory, the inclined side portions may be utilized as an aligning feature to align the sheet piles with the chassis of the soil stabilization system. For example, an alignment gripper which grasps the sheet pile in a thickness direction of the sheet piles may have a shape with corresponds to the central portion and side portions, so that the sheet pile is centered in the alignment gripper as a result of normal contact forces with the central portion 110 and inclined side portions 111.

Figure 11:
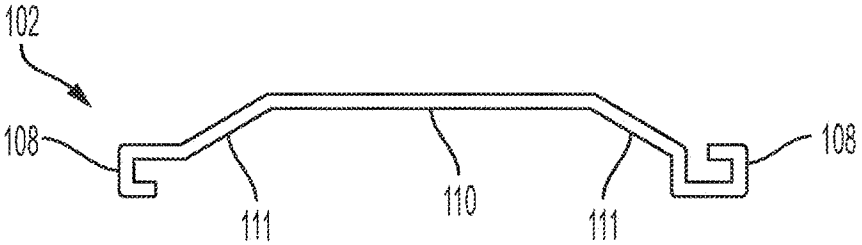
FIG. 11 is a top plan view of another embodiment of a sheet pile.

FIG. 11 is a top plan view of another embodiment of a sheet pile 102. The sheet pile also includes a central portion 110 and two side portions 111. On the ends of the side portions are interlocking slots 108 which allow the sheet pile to be interlocked with other sheet piles in a line. The central portion of FIG. 11 extends along the transverse axis of the sheet pile, and the side portions extend at an incline from the central portion. Accordingly, an aligner (e.g., an alignment gripper) with a shape that corresponds to the shape of the sheet pile may passively center the sheet pile in the aligner. Accordingly, in cases where the sheet pile has been driven and the aligner is mounted to a chassis of a soil stabilization system, the shape of the sheet pile may align the chassis with the sheet pile. That is, the transverse and/or longitudinal axis of the chassis may be aligned with the transverse and/or thickness axis of the sheet pile. Such an arrangement may assist with deploying sheet piles in an interlocking fashion, as the alignment of a previously-deployed sheet pile and a deployed sheet pile may be reliably promoted.

Figure 12:
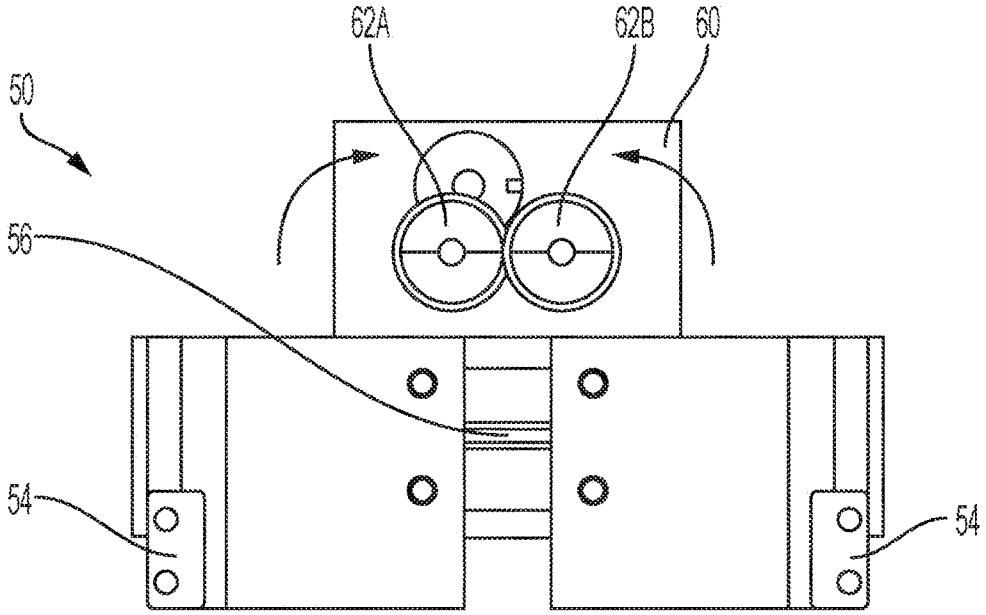
FIG. 12 is a front elevation view of one embodiment of a driving gripper.
Figure 13:
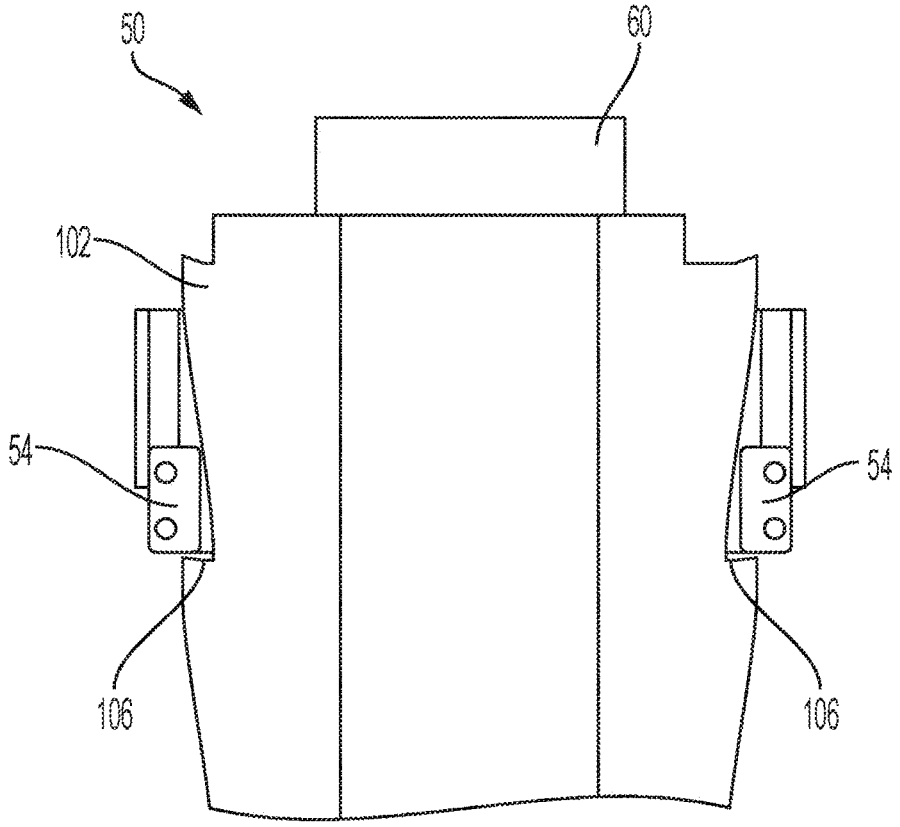
FIG. 13 is a front elevation view of the sheet pile of FIG. 9 being grasped by the driving gripper of FIG. 12.

FIGS. 12-13 show one embodiment of a driving gripper 50 which is configured as a payload gripper. As shown in FIG. 12, the payload gripper 50 is coupled to a vibratory hammer 60. The vibratory hammer includes first and second counter-rotating eccentric masses 62A, 62B. The masses are rotated in the direction shown by the arrows, so that vertical vibrations are created while horizontal (i.e., transverse) vibrations are canceled out. Two jaws 54 of the payload gripper are configured to grasp the sheet pile on transverse sides of the sheet pile. According to the embodiment shown in FIG. 12, the jaws are linked by a jaw actuator 56 which moves the jaws together or apart to correspondingly grasp or release a sheet pile. FIG. 13 shows the driving gripper grasping a sheet pile 102. As shown in FIG. 13, the jaws are closed around the transverse sides of the sheet pile 102 and are seated in notches 106 disposed on the transverse sides of the sheet pile. Accordingly, when some portion of weight is supported by the payload gripper, the vibratory hammer may be activated and the weight and vibrations transmitted to the sheet pile in a driving direction (i.e., down relative to the page) to drive the pile into underlying soil.

Figure 14:
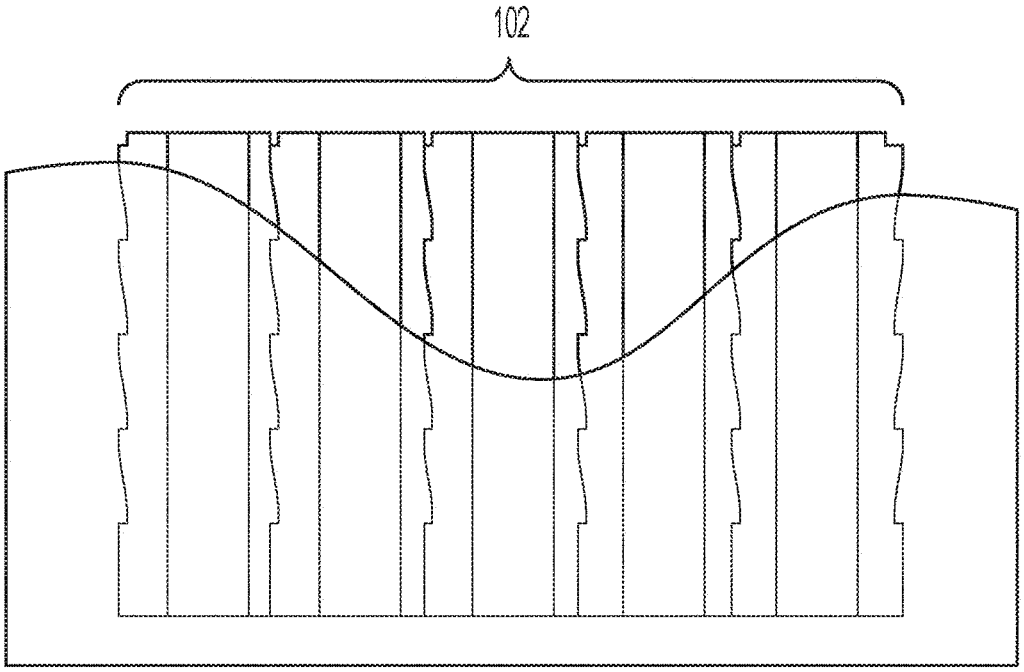
FIG. 14 a front elevation view of a plurality of the sheet piles of FIG. 9 deployed in soil.
Figure 15:
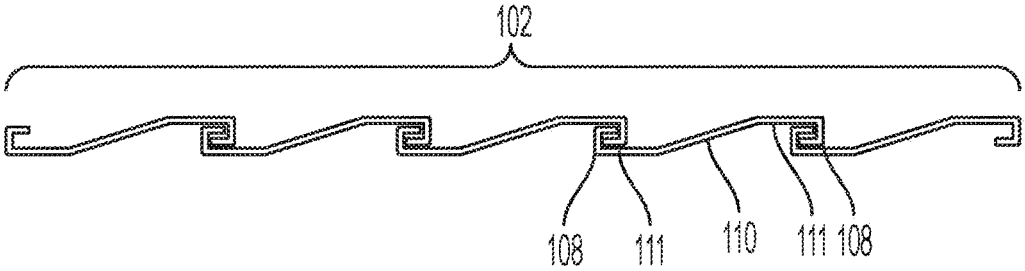
FIG. 15 is a top plan view of the plurality of deployed sheet piles of FIG. 14.

FIGS. 14-15 show a plurality of the sheet piles 102 of FIG. 9 deployed in soil. As shown in FIG. 14, the sheet piles are deployed in a linear manner, contacting the adjacent sheet pile(s) along the transverse edge of the sheet pile. A majority of the length of the sheet pile is in the soil, so that a majority of the deployed sheet piles is under the surface of the soil. As shown in FIG. 15, the sheet piles are interlocked with one another along a transverse edge. That is, the interlocking slots of adjacent sheet piles are coupled together so the plurality of sheet piles better resist forces in the thickness and transverse directions. Of course, the interlocking slots may be arranged in any suitable manner to better resist forces in any desirable direction, as the present disclosure is not so limited. Such an arrangement may also be beneficial in constructing ecological control structures such as check dams.

Figure 16:
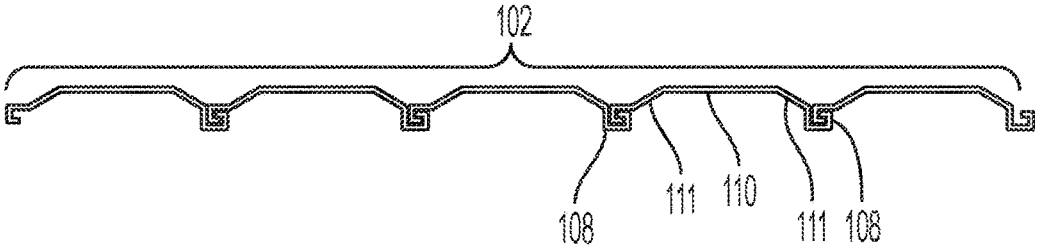
FIG. 16 is a top plan view of a plurality of the sheet piles of FIG. 11 deployed in soil.

FIG. 16 is a top plan view of a plurality of the sheet piles of FIG. 11 deployed in soil. Similarly to the sheet piles shown in FIGS. 14-15, the sheet piles have interlocking slots which are coupled to one another along the transverse sides of the sheet piles. With the interlocking slots coupled, the plurality of sheet piles better resist force in the transverse and thickness directions, as the strength of an individual sheet pile is combined with the adjacent sheet piles. A plurality of sheet piles may be deployed linearly in a continuous fashion by a soil stabilization system until, for example, the soil stabilization system is out of sheet piles to deploy.

Figure 17:
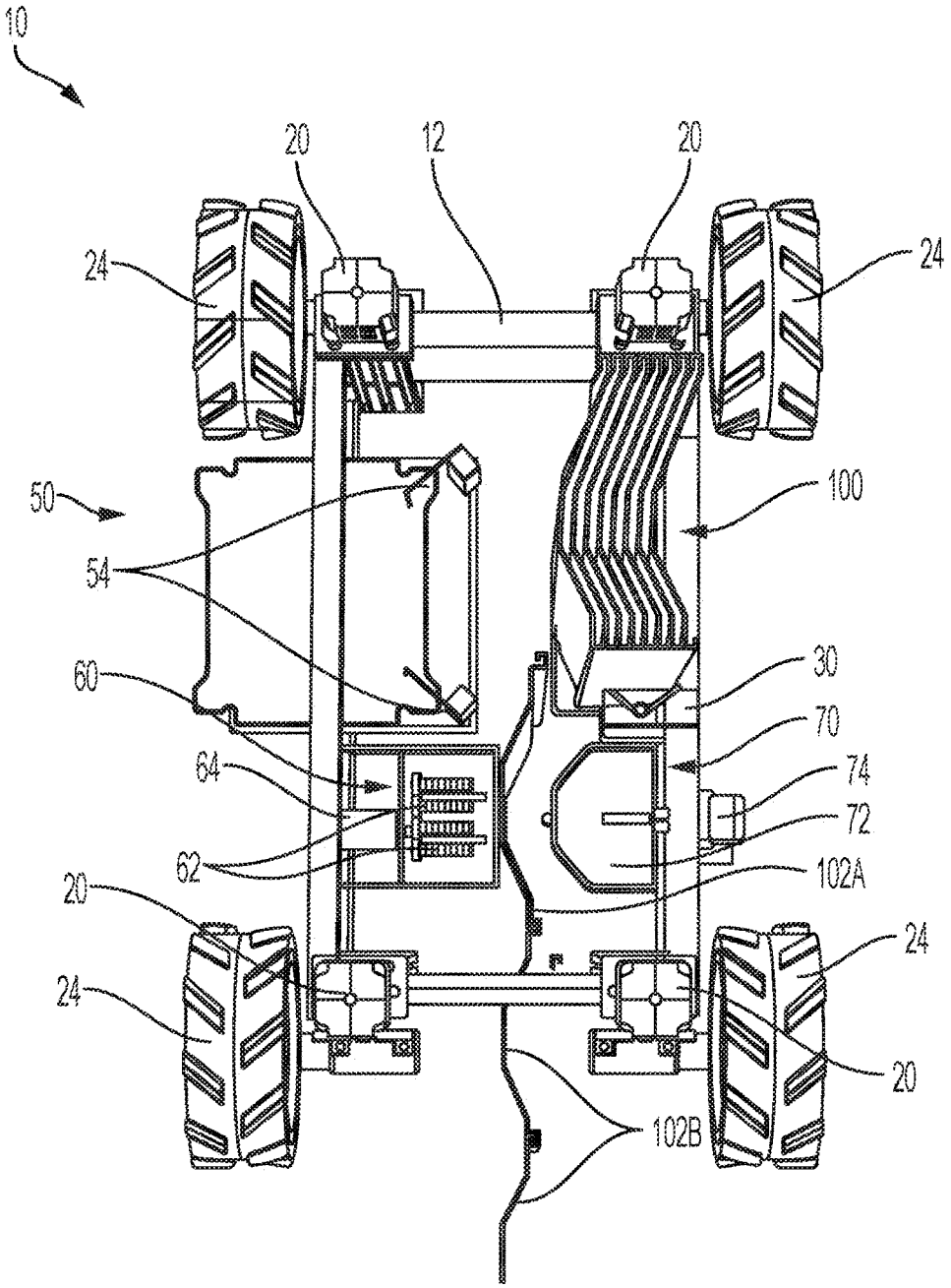
FIG. 17 is a top view of the self-contained soil stabilization system of FIG. 1 during an alignment and/or driving process.
Figure 18:
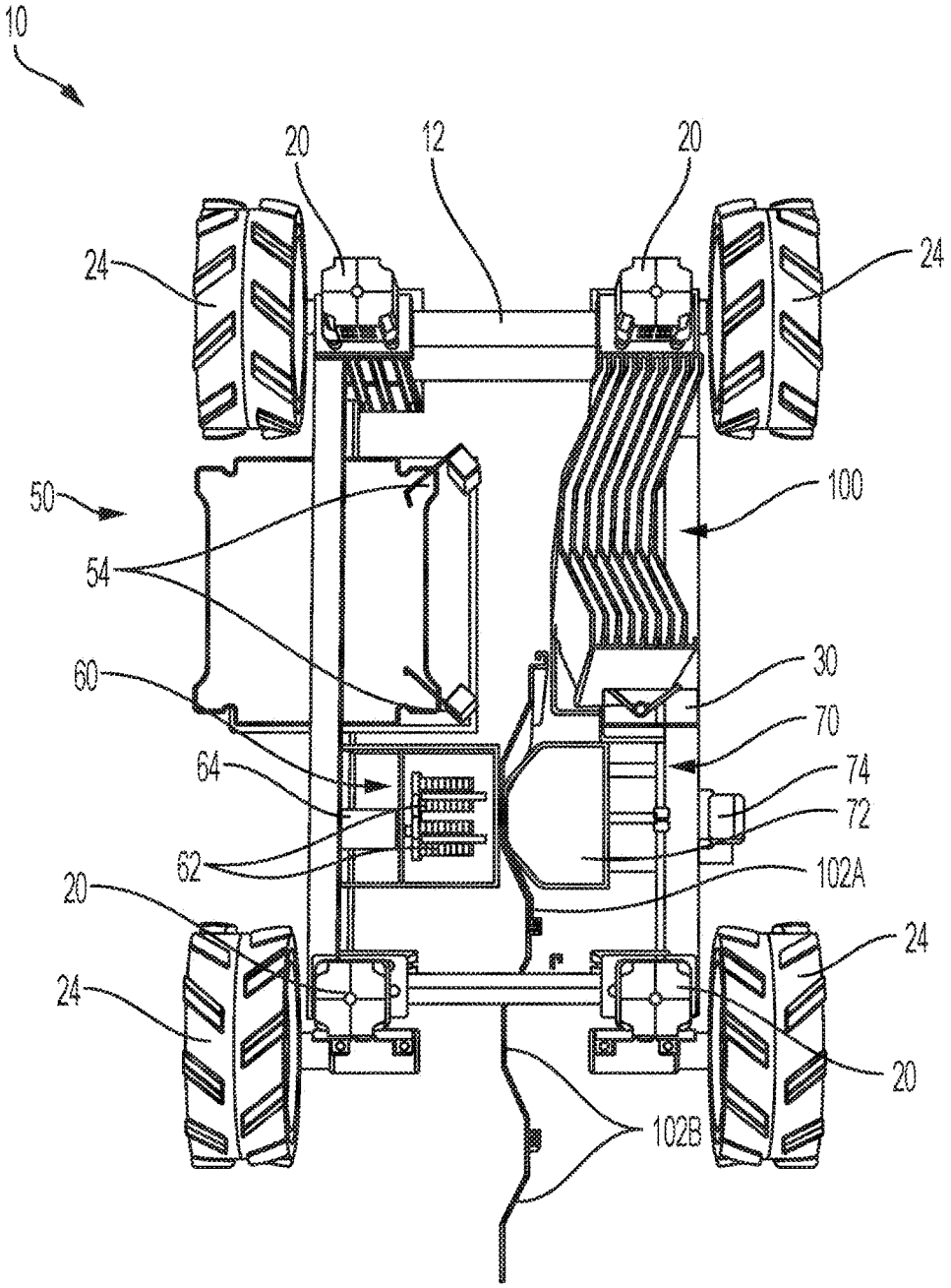
FIG. 18 is a top view of the self-contained soil stabilization system of FIG. 1 during an alignment and/or driving process.

FIGS. 17-18 show a top view of the self-contained soil stabilization system 20 of FIG. 1 during an alignment and/or driving process. As discussed previously, according to the depicted embodiment the driving gripper is integrated into an aligner 70 of the soil stabilization system. As shown in FIG. 17, the aligner 70 includes a vibratory hammer 60 and alignment jaw 72. The alignment jaw is movable by a linear actuator 74 toward or away from the vibratory hammer. As discussed previously, the vibratory hammer includes two counter-rotating eccentric masses 62 which are rotated by a vibratory motor 64 upon receipt of a vibration command from a controller. As shown in FIG. 17, the alignment jaw 72 is shaped correspondingly to the top profile of sheet piles 102A, 102B carried as a payload 100 of the soil stabilization system. In the state shown in FIG. 17, the aligner may be operated to align the chassis with a linear array of previously-deployed piles in the case where the deployed pile is already driven, or may be used to drive a pile as discussed previously with reference to FIGS. 2-5. As shown in FIG. 17, the deployed pile 102A has been driven and interlocked with previously-deployed piles 102B. Accordingly, the aligner may be used to align the chassis 12 of the soil stabilization system with the linear array of deployed piles. As shown in FIG. 17, the alignment jaw 72 has a shape which corresponds to a top profile shape of the deployed piles, shaped similar to those shown in FIGS. 10 and 15. Accordingly, when the alignment jaw closes the deployed sheet pile 102A in between the alignment jaw 72 and the vibratory hammer 60, the chassis may be moved as the deployed sheet pile is stationary as a result of being disposed in the underlying soil and/or interlocking with the previously-driven pile.

FIG. 18 shows the alignment jaw 72 closed on the deployed sheet pile 102A in order to center and align the chassis with the deployed sheet pile. The alignment jaw has been moved toward the vibratory hammer, grasping the deployed sheet pile between the vibratory hammer and the alignment jaw. Without wishing to be bound by theory, the grasping of the top profile of the sheet pile results in the alignment and centering of the chassis as a result of the normal contact forces between the alignment jaw and the sheet pile. That is, the chassis 12 of the soil stabilization system is moved until the alignment jaw is substantially flush with the sheet pile. When the alignment jaw is flush with the sheet pile top profile, the longitudinal axis of the chassis may be aligned with the transverse axis of the linear array of the deployed sheet piles. Additionally, the chassis may be moved such that the payload gripper 50 is aligned with the deployed sheet pile 102A, so that when the next sheet pile is deployed the interlocking slots are aligned without further movement by the soil stabilization system.

Figure 19:
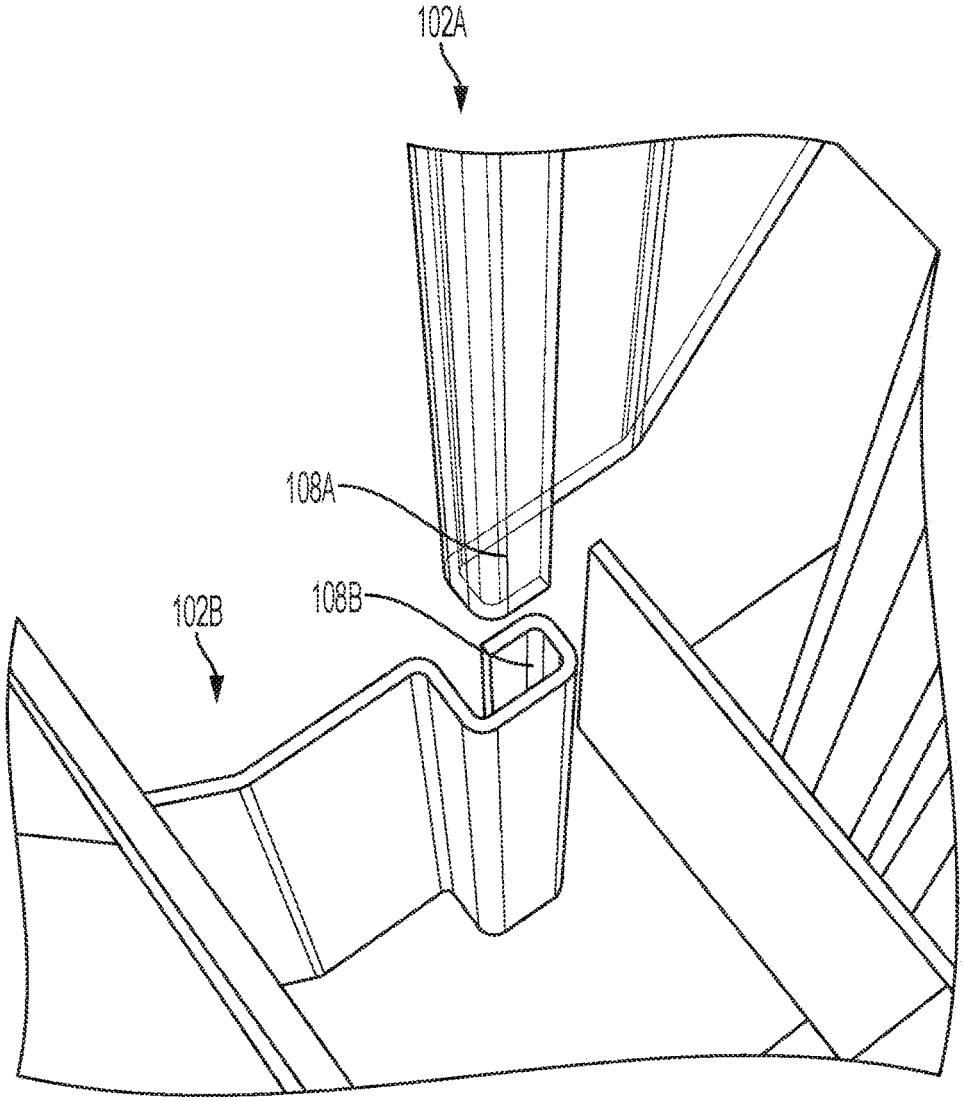
FIG. 19 depicts an enlarged view of one embodiment of sheet pile in the process of interlocking with another sheet pile.

FIG. 19 depicts an enlarged view of one embodiment of deployed sheet pile 102A in the process of interlocking with another sheet pile 102B. As shown in FIG. 19, the previously-deployed sheet pile 102B is disposed in underlying soil. An aligner of the soil stabilization system has aligned the soil stabilization system with the previously-deployed pile, so that the deployed sheet pile 102A is in alignment with the previously-deployed pile. That is, the interlocking slot 108B of the previously-deployed pile is aligned with the interlocking slot 108A of the deployed sheet pile so that when the deployed sheet pile 102A is dropped the interlocking slots are coupled. Thus, the aligner may promote reliable interlocking between the deployed sheet pile and previously-deployed sheet pile without adjusting the position of the deployed sheet pile directly. The deployed sheet pile 102A and previously-deployed sheet pile 102B may be aligned using any suitable arrangement, including movable grippers, as the present disclosure is not so limited.

Figure 21:
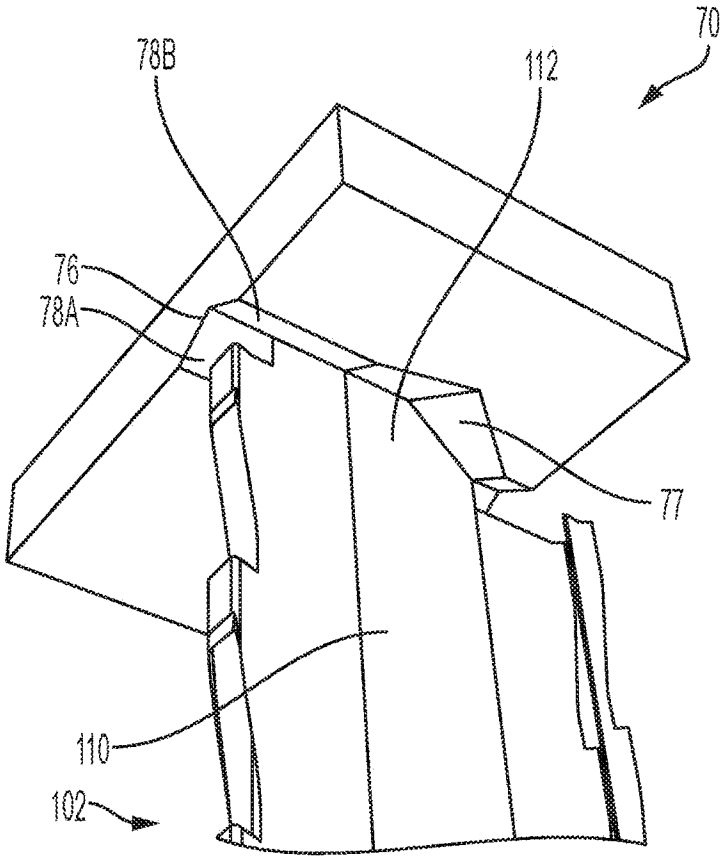
FIGS. 20-21 are perspective views of one embodiment of an aligner and sheet pile.
Figure 20:
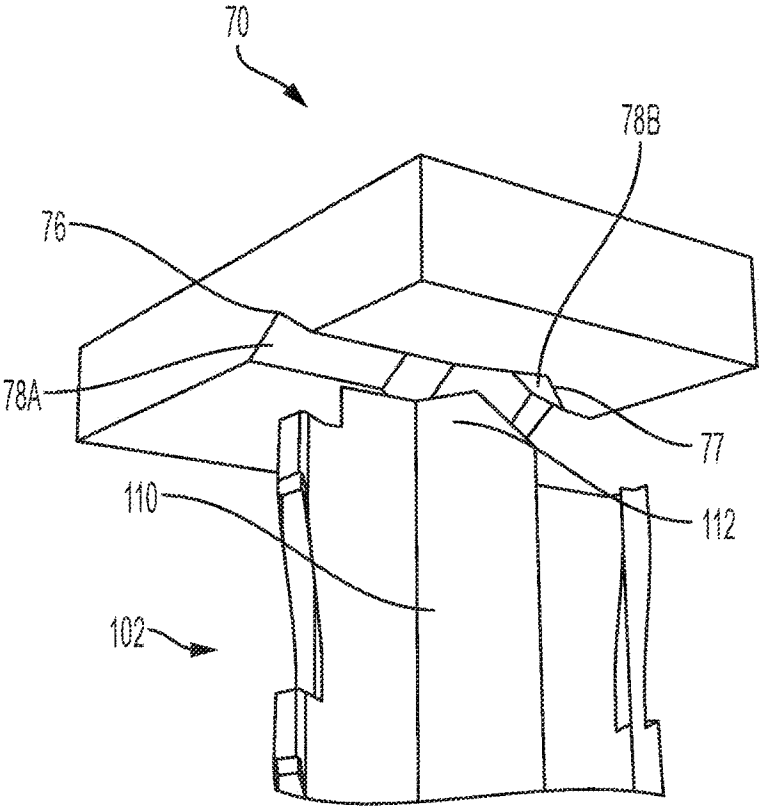

FIGS. 20-21 are perspective views of one embodiment of an aligner 70 and sheet pile 102. In contrast to the aligner shown in FIGS. 17-18, the aligner of FIGS. 20-21 is a passive component with no movable jaw. That is, the aligner may be mounted on a chassis of the soil stabilization system, and the movement of the chassis may be used to align the chassis with any previously-deployed sheet piles. As shown in FIG. 20, the aligner includes a first concave slot 76 extending in a first direction and a second concave slot 77 extending in a second direction. Both slots are linked by continuous inclined surfaces 78A, 78B on either side of the slot. According to the embodiment shown in FIGS. 20-21, the aligner may be mounted on the chassis of a soil stabilization system with the first concave slot and second concave slots facing a downward direction relative to gravity. As the aligner is mounted to the chassis of the soil stabilization system, it may be moved up and downward relative to the wheels via one or more independent suspension elements. The aligner of FIGS. 20-21 is configured to be positioned over a top convex portion 112 of a sheet pile 102, and lowered by the independent suspension elements to align and center the chassis relative to the previously-deployed sheet pile. As the top convex portion 112 of the sheet pile 102 has a shape which corresponds to the shape of the concave slots, the chassis of the soil stabilization system may be centered and aligned with the previously-deployed sheet pile as the chassis is lowered.

FIG. 21 depicts the aligner 70 mated with a previously-deployed sheet pile 102. As shown in FIG. 21, the top convex portion 112 of the sheet pile is disposed in the first concave slot 76 and second concave slot 77. As a result of the normal contact forces with the inclined surfaces 78A, 78B, the sheet pile is aligned and centered within the first and second concave slots. Thus, the aligner may align the chassis with a previously-deployed sheet pile. Although an aligner with a first concave slot and a second concave slot extending in different directions is shown in FIGS. 20-21, any suitable number of slots extending in any suitable direction may be employed, as the present disclosure is not so limited.

Figure 22:
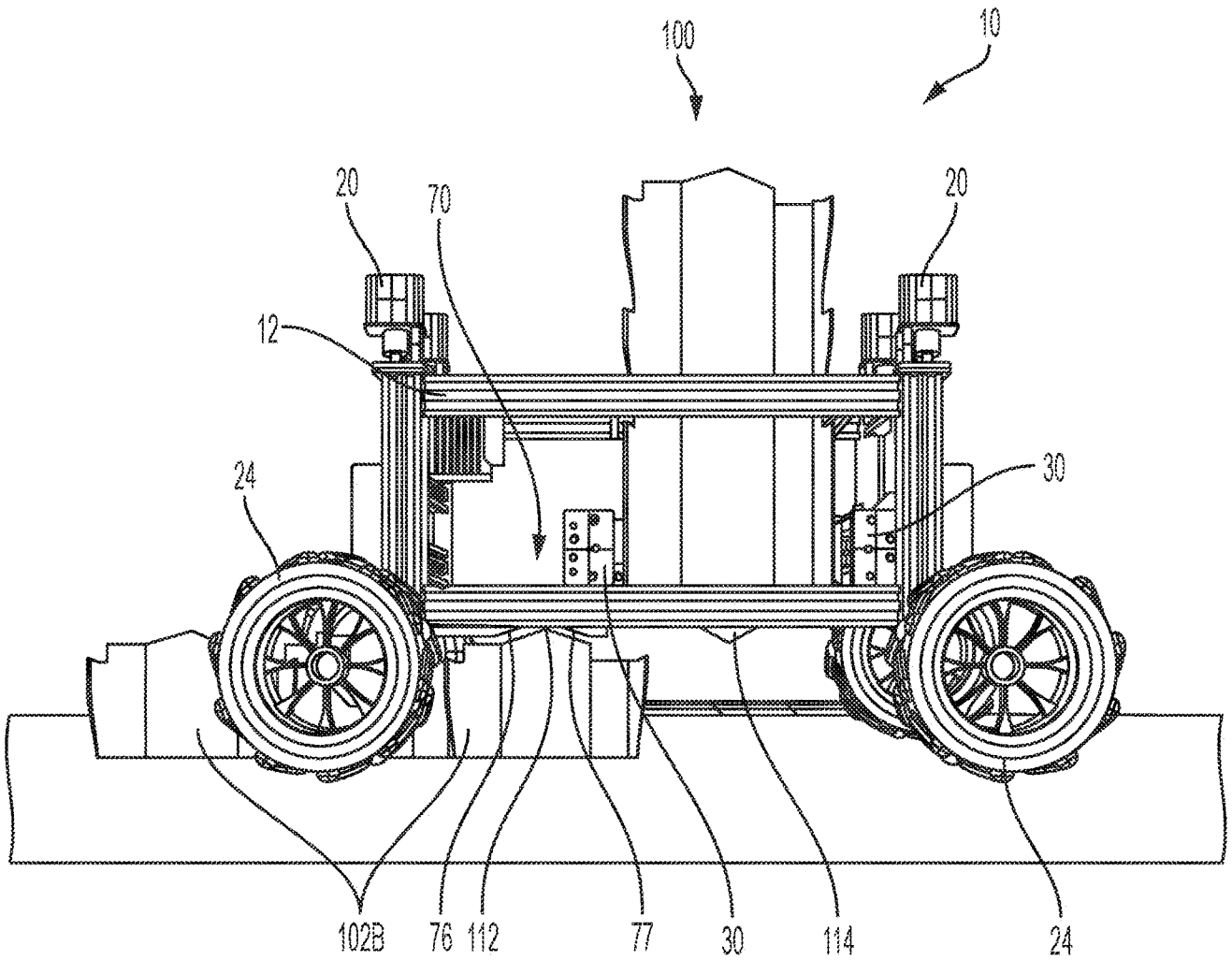
FIG. 22 is a side elevation view of one embodiment of a self-contained soil stabilization system including the aligner of FIGS. 19-20 during an alignment process.

FIG. 22 is a side elevation view of one embodiment of a self-contained soil stabilization system 10 including the aligner 70 of FIGS. 20-21 during an alignment process. According to the embodiment shown in FIG. 22, the payload gripper (not shown) of the self-contained soil stabilization system is a driving gripper which grasps the sheet piles and suspends the soil stabilization system from a deployed sheet pile to drive the sheet pile. The aligner is disposed on the chassis with the first concave slot 76 and second concave slot 77 oriented in a downward direction toward the previously-deployed sheet piles 102B. As shown in FIG. 22, the slot 76 is oriented toward the convex top portion 112 of the previously-deployed sheet pile. Accordingly, when the independent suspension elements 14 lower the chassis 12 via linear actuators 20 (e.g., upon receipt of a suspension command from a controller), the aligner will contact the top convex portion 112 and align the chassis with the previously-deployed pile. When the aligner is in contact with the previously-deployed sheet pile, another sheet pile may be deployed from the payload 100 (e.g., via the payload gripper) and fall with interlocking slots on the newly-deployed sheet pile and previously-deployed sheet pile interlocking. Thus, a continuous line of interlocked sheet piles may be reliably driven by the self-contained soil stabilization system. According to the embodiment shown in FIG. 22, each of the piles includes a pointed tip 114 which may assist in soil penetration.

Figure 23:
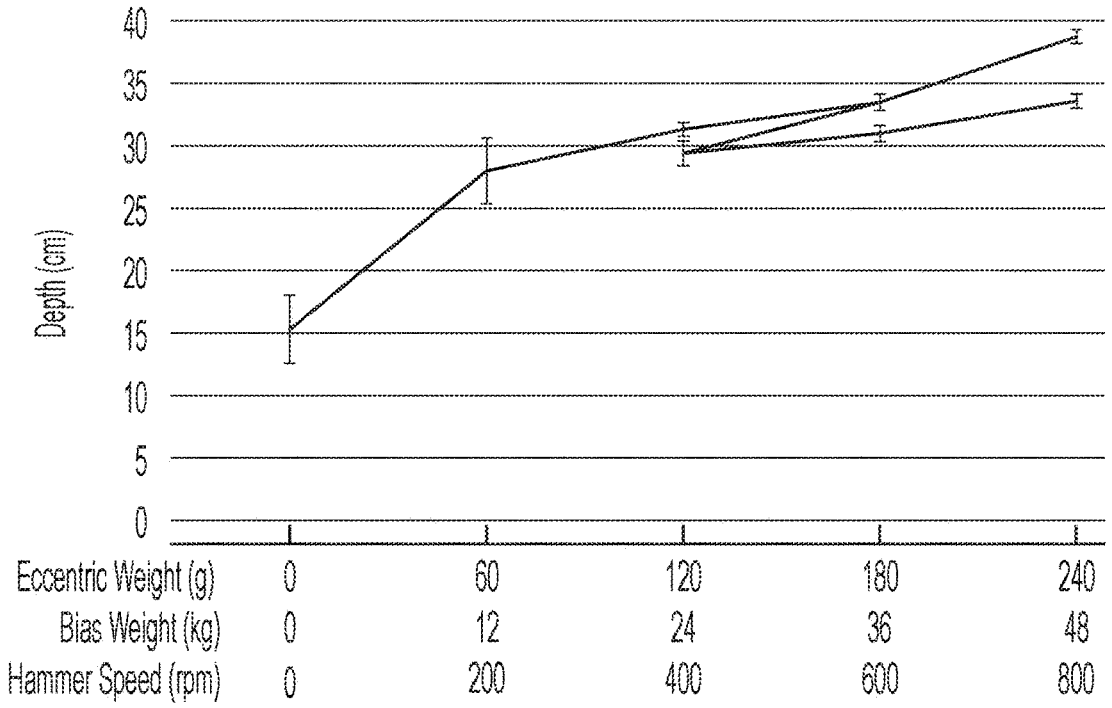
FIGS. 23-24 depict experimental results of one embodiment of a self-contained soil stabilization system.
Figure 24:
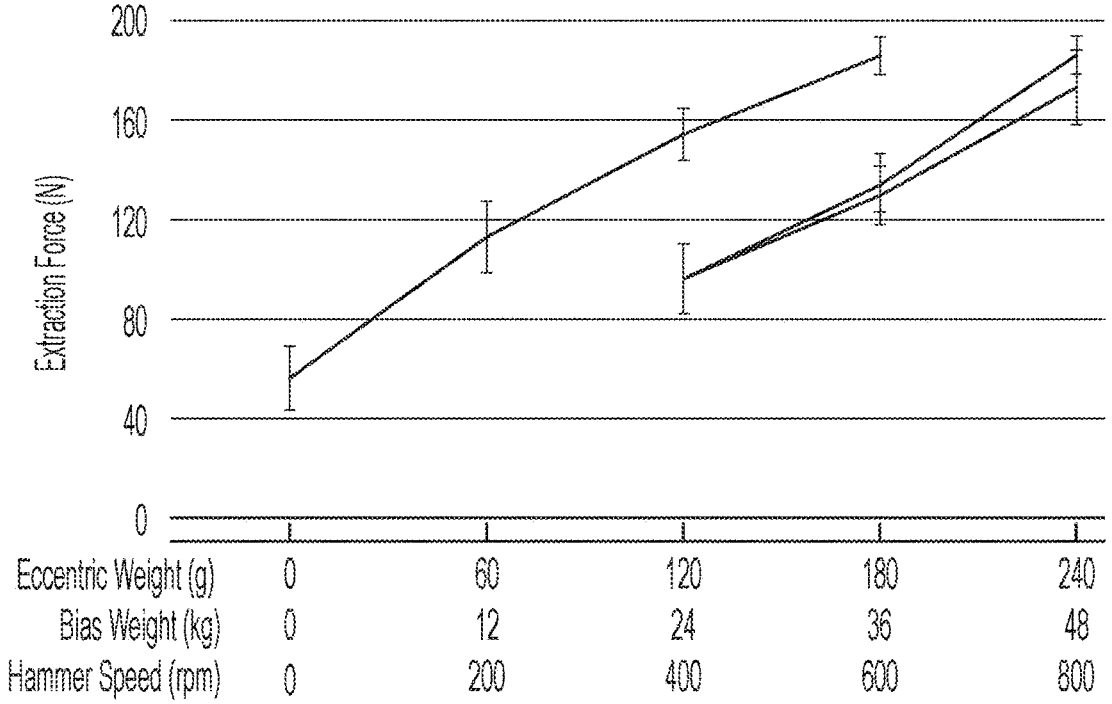

Based on exemplary embodiments described herein, an experimental self-contained soil stabilization system was built and tested. In order to quantitatively characterize the soil stabilization pile driving abilities, a testing arena was constructed. The experiments for characterizing performance were conducted in an artificial sandbox filled with coarse sand. The sand was tested in an uncompacted state. The sandbox was 48 cm deep, though piles were never driven more than 40 cm, thereby avoiding edge effects near the bottom of the sandbox. The performance measures considered in these exemplary experiments were the depth to which a pile was driven and the force required to remove it afterwards. Three series of trials were conducted in order to evaluate the effects of modifying eccentric weight, bias weight, and frequency of a vibratory hammer. Each trial was halted once the resistance of the sand could no longer be overcome by the soil stabilization system, with one or more of the wheels starting to lift off of the surface of the sand. As shown in FIG. 23, the driven depth was then measured and recorded for a variety of exemplary configurations. The measured results indicate that increasing any of the three parameters may result in approximately linear gains in the driven depth over this range. However, turning the hammer off (e.g., by setting the frequency of the hammer to 0 RPM) may result in reduced performance, demonstrating the effectiveness of the vibratory hammer compared to pressure alone. As shown in FIG. 24, measurements were also taken of the upward force required to extract the driven pile from the sandbox. Increasing the values of the eccentric weight, bias weight, and vibration frequency each resulted in approximately linear increases in the force required to extract the driven pile.

Figure 25:
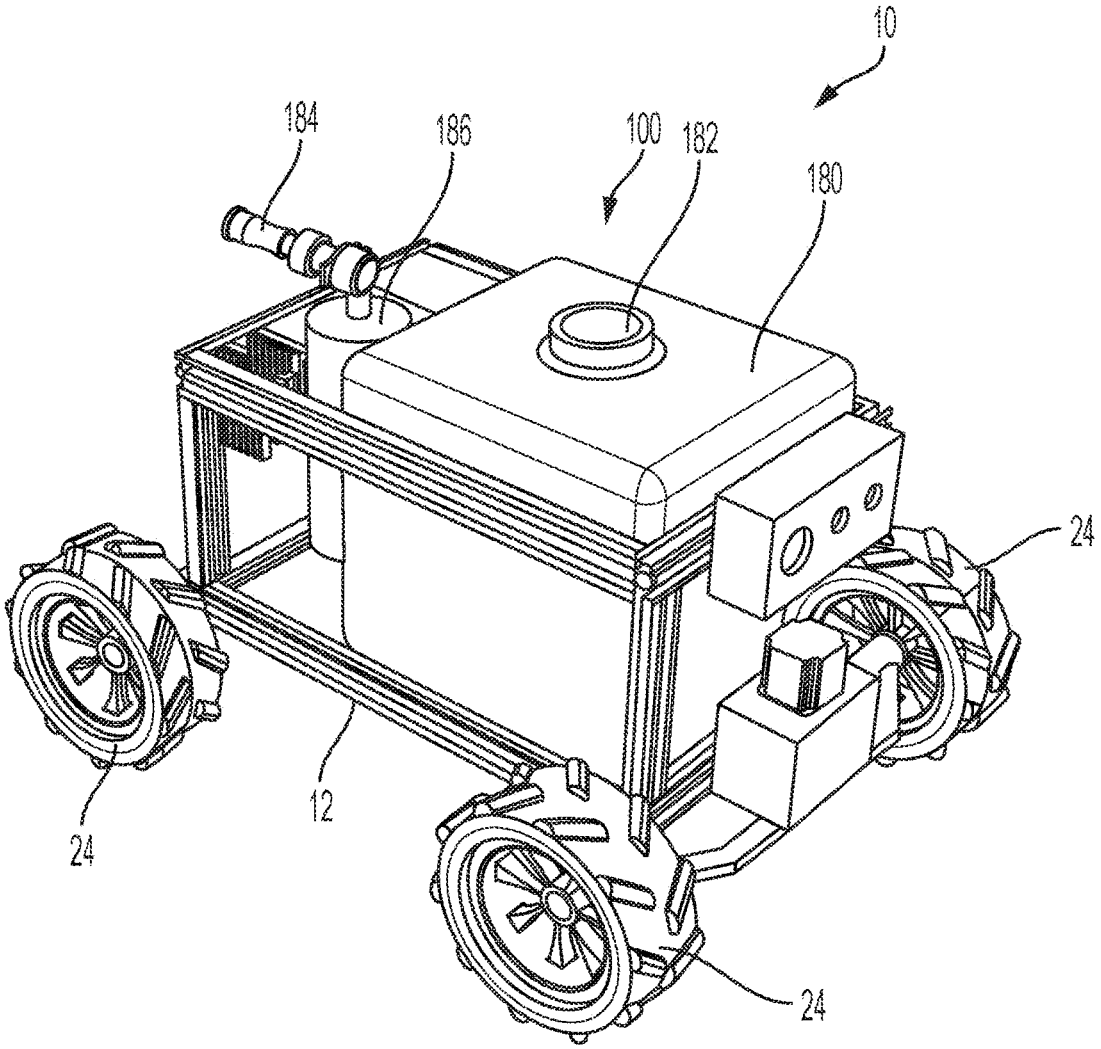
FIG. 25 is a perspective view of another embodiment of a self-contained soil stabilization system and payload.

FIG. 25 depicts another embodiment of a self-contained soil stabilization system 10 including a tank 180 for carrying a payload 100 of a chemical or biological soil stabilization agent. As shown in FIG. 25, the tank is attached to a chassis 12 which is supported by wheels 24. The tank includes an access port 182 which may be used to fill the tank with a fluidic payload (e.g., from a supply cache). According to the embodiment of FIG. 25, the self-contained soil stabilization system includes a nozzle 184 coupled to a nozzle base 186 which may be used to deliver the soil stabilization agent to the underlying soil. The nozzle base may pressurize or otherwise facilitate the conduction of the contents of the tank 180 to the nozzle 184. In some embodiments, the nozzle base may be controllable to allow the nozzle 184 to be steered or directed for more effective spreading or directed application of a soil stabilization agent. The nozzle 184 may be any suitable nozzle which spreads or directs a flow of a soil stabilization agent to underlying soil.

Figure 26:
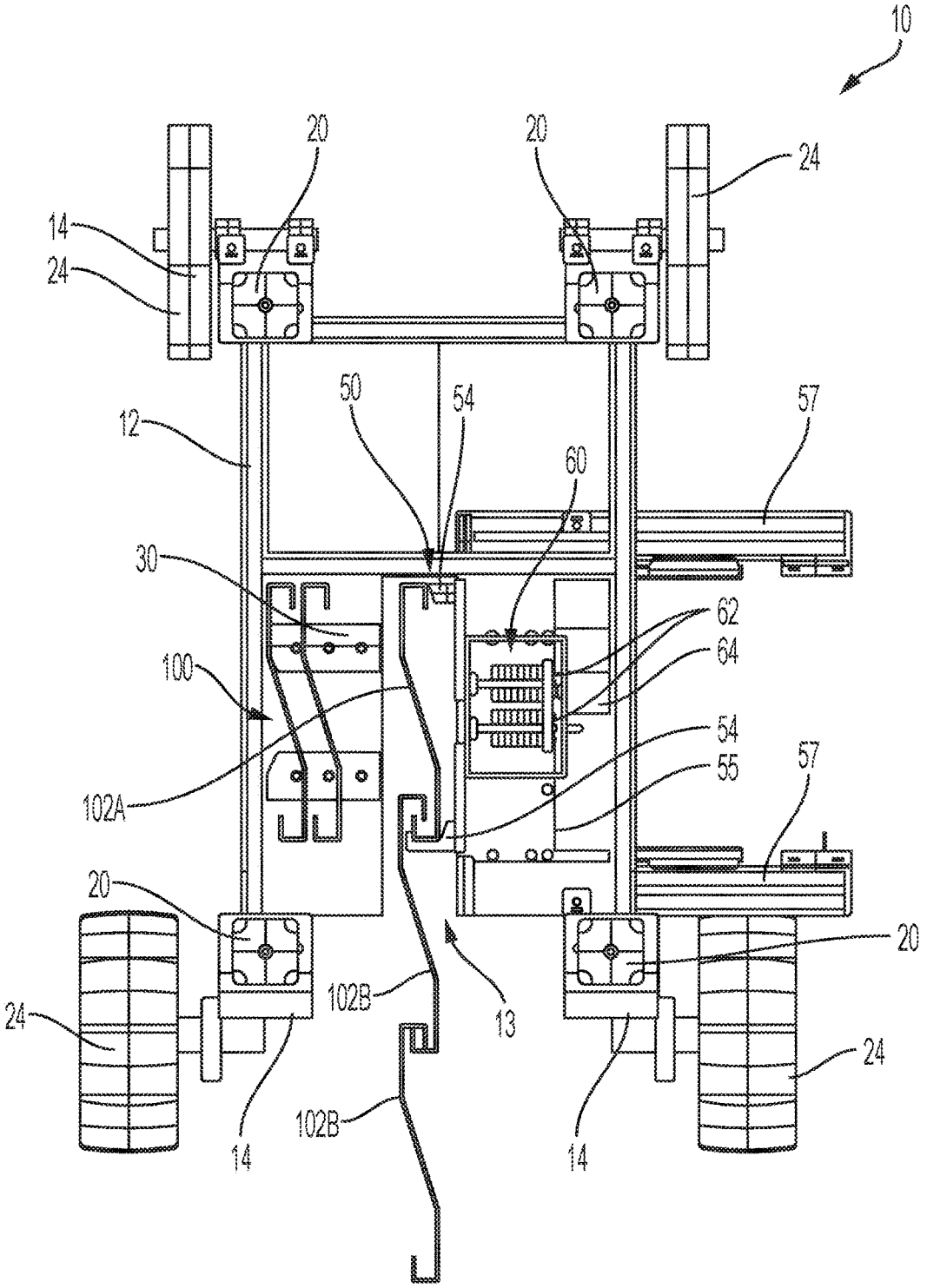
FIG. 26 is a top plan view of another embodiment of a self-contained soil stabilization system and payload.

FIG. 26 depicts a top plan view of another embodiment of a self-contained soil stabilization system 10. According the embodiment of FIG. 26, the chassis 12 is U-shaped to allow partially driven or otherwise tall piles to be driven and released without interference from the chassis. As shown in FIG. 26, the chassis includes an opening 13 through which previously deployed piles 102B and a deployed pile 102A may fit. Accordingly, regardless of the height of the pile relative to the chassis, the deployed pile 102A or previously deployed piles 102B will not interfere with the locomotion of the self-contained soil stabilization system. For example, once a pile is driven, the chassis of the self-contained soil stabilization system does not need to be lifted as the chassis may locomote forward as the deployed sheet pile passes through the opening 13. Such an arrangement may also be beneficial for reengaging previously deployed piles for extraction when the pile is high enough to interfere with the chassis. For example, a self-contained soil stabilization system may be reversed so that a previously deployed pile or other object enters the opening 13 where it may be engaged centrally by a payload gripper 50.

According to the embodiment of FIG. 26, the payload gripper 50 is configured as a driving gripper. That is, the vibratory hammer 60 is coupled to the payload gripper so that when the payload gripper grasps a pile from the hopper 30, the payload gripper may be subsequently used to drive the pile in accordance with exemplary embodiments described herein. Additionally, as shown in FIG. 26, payload gripper jaws 54 are mounted on a payload gripper base 55 which is moveable toward or away from the hopper 30 on two guide rails 57. Of course, as discussed previously, any suitable arrangement of the jaws 54 of the payload gripper may be employed with or without the payload gripper base 55, as the present disclosure is not so limited.

Figure 27:
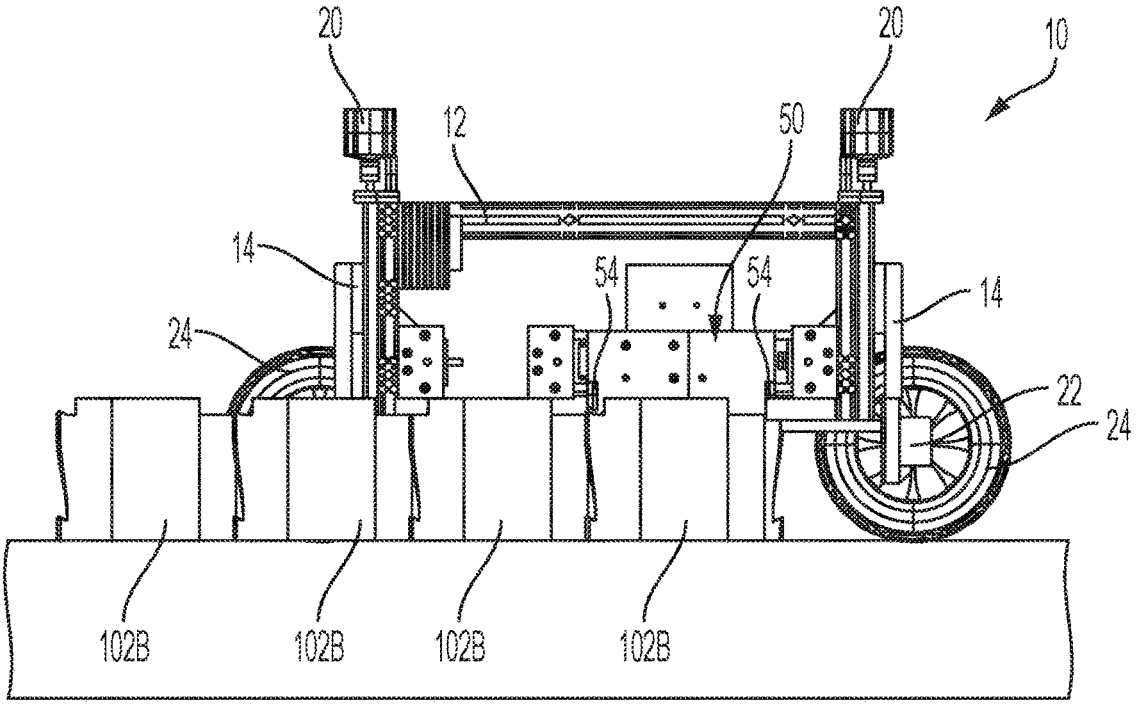
FIG. 27 is a side elevation view of another embodiment of a self-contained soil stabilization system.
Figure 28:
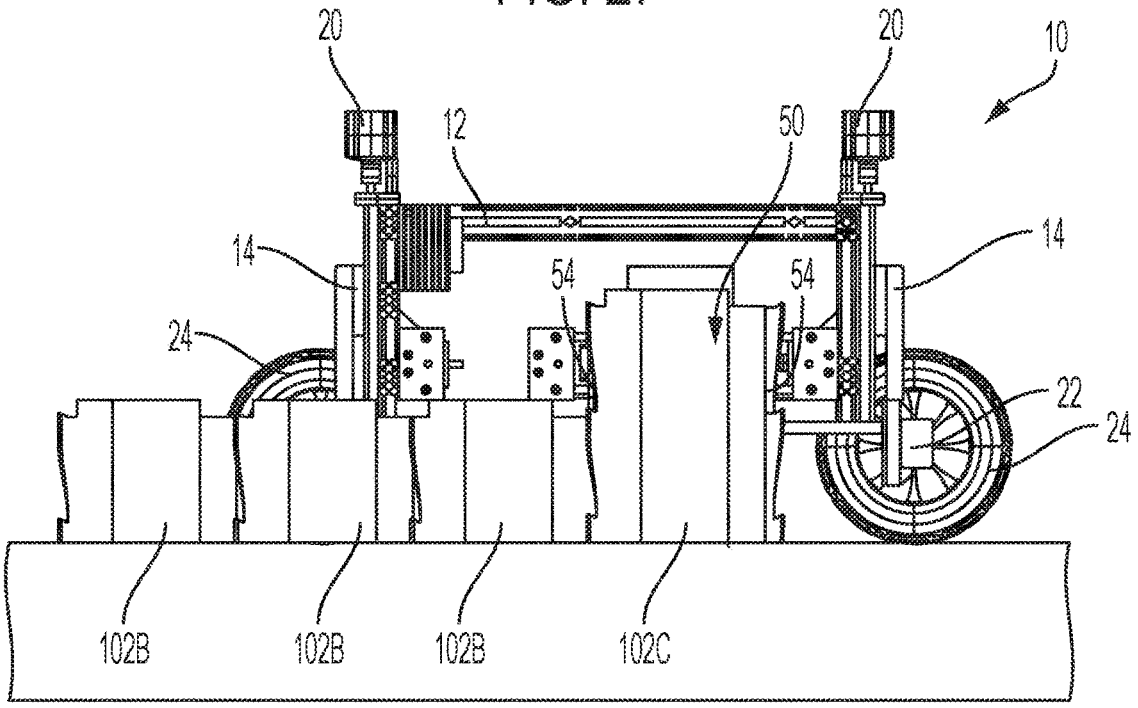
FIG. 28 is a side elevation view of the self-contained soil stabilization system of FIG. 27 during a pile extraction process.

FIGS. 27-28 depict one embodiment of a self-contained soil stabilization system during a pile extraction process. In some cases, it may be desirable to extract previously or partially driven piles in cases where an obstacle (e.g., a rock) prevents suitable driving or when soil stabilization is no longer desired. Accordingly, a gripper of the self-contained soil stabilization system may be used to grasp and extract the piles using a process which is inverse to that described with reference to FIG. 7. According to the embodiment shown in FIGS. 27-28, the self-contained soil stabilization system includes a payload gripper 50 which may be used to retrieve a pile from the hopper, drive the retrieved pile, and extract a previously or partially deployed pile. Of course, in other embodiments, a separate extraction gripper or another gripper such as an alignment gripper may be employed to grasp and extract a previously or partially deployed pile, as the present disclosure is not so limited. Such an arrangement may be beneficial in the state shown in FIG. 27, where the piles overlap each other sufficiently to inhibit grasping along their transverse sides. Nevertheless, as shown in FIG. 28, a partially-deployed pile 102C may be grasped by the jaws 54 of the payload gripper 50. Once grabbed, linear actuators 20 may lift a chassis 12 of the self-contained soil stabilization system so that the grasped pile is removed at least partially from the underlying soil. Once the chassis 12 has reached its maximum height, the pile may be released. Depending on the depth of the pile, the chassis may be lowered and the process repeated as necessary in order to extract the previously deployed pile. In some embodiments, the payload gripper may be configured to replace the pile in a hopper so that it may be stored and used again at another target pile location. In other embodiments, the payload gripper may be configured to hold the extracted pile for deployment at another target location.

Figure 29:
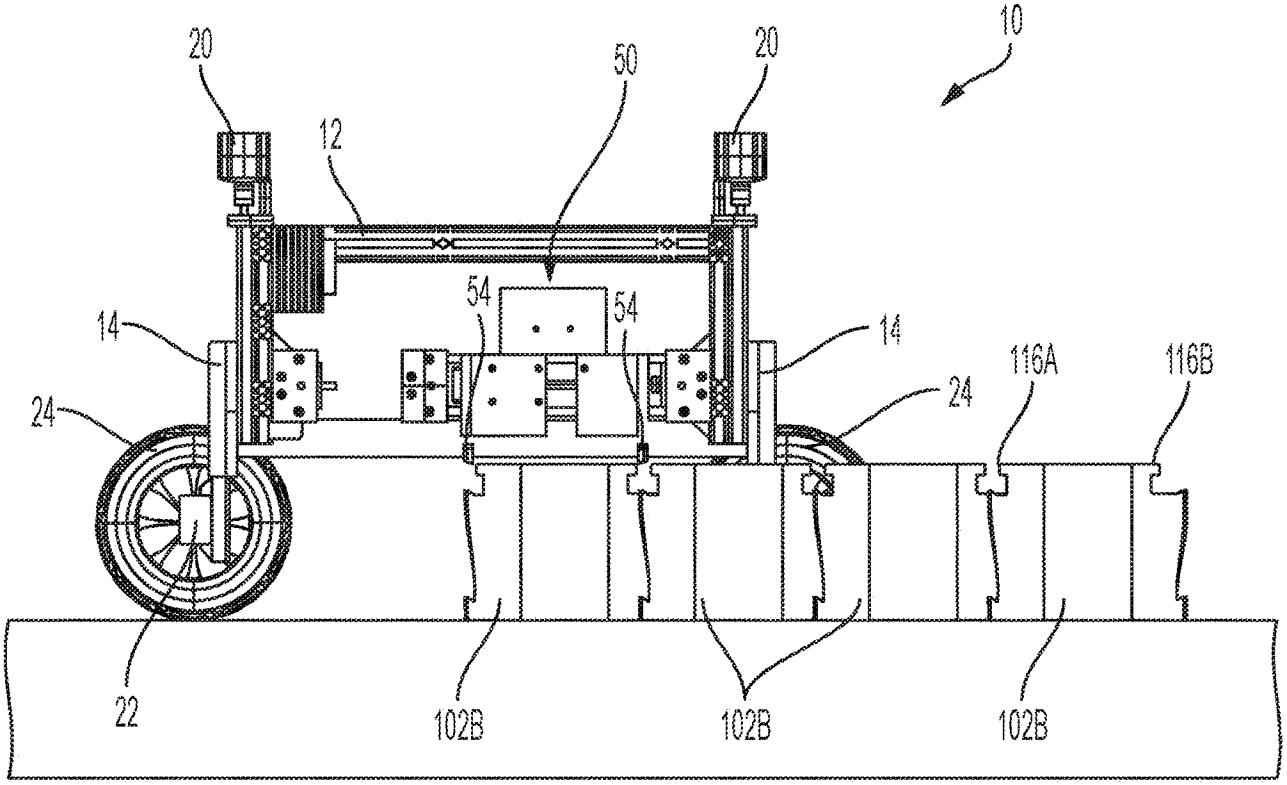
FIG. 29 is a side elevation view of another embodiment of a self-contained soil stabilization system and sheet pile.

FIG. 29 depicts another embodiment of a self-contained soil stabilization system 10 during a pile extraction process. As shown in FIG. 29, each of the previously deployed piles 102B includes a first extraction catch 116A and a second extraction catch 116B. The extraction catches may be configured to allow the previously deployed pile to be grasped along its transverse sides by jaws 54 of a payload gripper 50. Accordingly, a fully deployed pile which is interlocked with other previously deployed piles may be extracted by the payload gripper as the extraction catches provide space for the jaws 54 to grasp the pile. Of course, any suitable arrangement of the gripper and extraction catches may be employed, as the present disclosure is not so limited.

Figure 30:
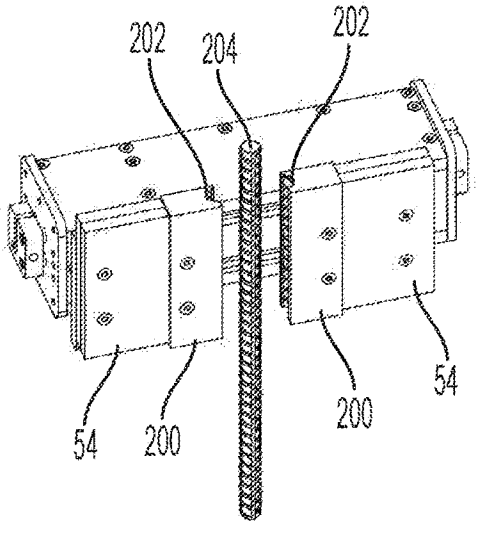
FIG. 30 is a front elevation view of another embodiment of a driving gripper.

FIG. 30 is a front elevation view of another embodiment of a driving gripper including two opposing jaws 54. According to the embodiment shown in FIG. 30, each of the jaws includes a gripper attachment 200. The gripper attachments are coupled to the opposing jaws 54 such that the gripper attachments engage a pile or other elongated material when the jaws are closed. As discussed above, when the jaws engage a pile, they may do so to apply force to the grasped pile to drive the pile into an underlying surface. A pile may take a variety of different forms for different driving applications. As discussed with reference to previous embodiments described herein, sheet piles may be employed with a driving gripper. According to the embodiment of FIG. 30, the driving gripper is configured to grasp and drive rebar 204. Each of the gripper attachments 200 includes a recess 202 with a pattern of ridges matching a corresponding ridge pattern on the rebar. Such an arrangement may improve the force transmission between the gripper attachments and the rebar 204 when the rebar is grasped by the jaws 54 so that the rebar is securely held.

Figure 31:
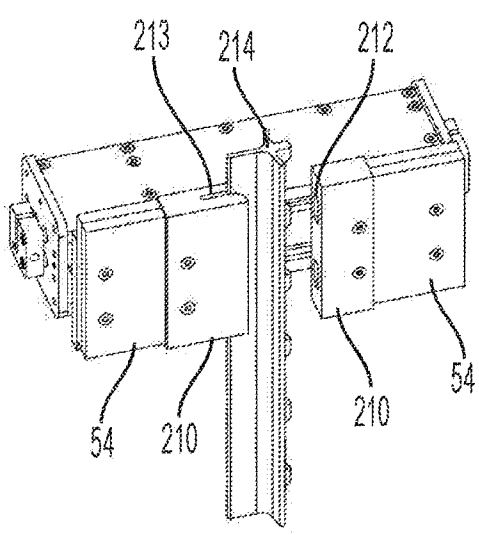
FIG. 31 is a front elevation view of yet another embodiment of a driving gripper.

FIG. 31 is a front elevation view of yet another embodiment of a driving gripper including two opposing jaws 54. Similar to the embodiment of FIG. 30, the jaws 54 each include gripper attachments 210. The gripper attachments 210 are configured to facilitate grasping and driving of a non-symmetrical T-bar 214. To facilitate grasping of the non-symmetric T-bar 214, one of the gripper attachments includes holes 212 while the other of the gripper attachments includes a slot 213. The holes and slot of the gripper attachments are configured to each engage different portions of the T-bar 214 such that the T-bar is securely held between the jaws 54 when the jaws are closed.

Figure 32:
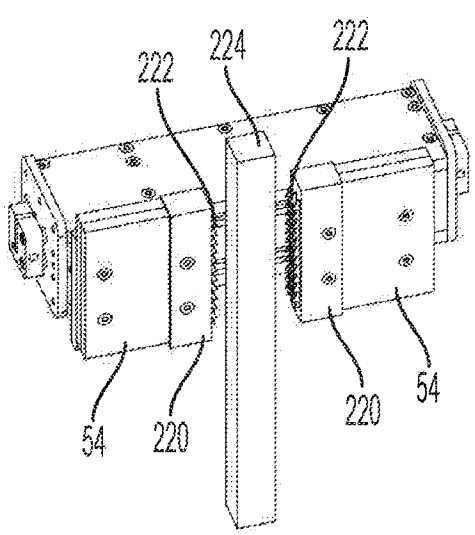
FIG. 32 is a front elevation view of yet another embodiment of a driving gripper.

FIG. 32 is a front elevation view of yet another embodiment of a driving gripper including opposing jaws 54. Similar to the embodiments of FIGS. 30 and 31, the jaws 54 include gripper attachments 220 configured to facilitate grasping different types of piles or otherwise elongated materials. According to the embodiment of FIG. 32, the gripper attachments include a plurality of angular teeth 222. The angular teeth may be well suited for grasping a wooden post 224 of various dimensions. The angular teeth may be formed of a rigid material (e.g., metal, plastic, etc.) which may bite into the wood when the jaws 54 are closed to facilitate a secure grasp of the wooden post. The angles of the teeth may allow the gripping force to be stronger when applying force (e.g., driving force) to the wooden post 224 in one direction. Such an arrangement may allow the gripper attachments to remain secure on the wooden post 224 while driving the wooden post into an underlying surface, while allowing the gripper attachments to release when the jaws are moved apart 54 or the driving gripper is otherwise moved in an opposite direction relative to the post. While specific gripper attachments and materials are shown in FIGS. 30-32, it should be noted that other suitable gripper attachments and driven materials may be employed with the systems according to embodiments described herein, as the present disclosure is not so limited.

The above-described embodiments of the technology described herein can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the embodiments described herein may be embodied as a computer readable storage medium (or multiple computer readable media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computers or other processors to implement various aspects of the present disclosure as discussed above. As used herein, the term "computer-readable storage medium" encompasses only a non-transitory computer-readable medium that can be considered to be a manufacture (i.e., article of manufacture) or a machine. Alternatively or additionally, the disclosure may be embodied as a computer readable medium other than a computer-readable storage medium, such as a propagating signal.

The terms "program" or "software" are used herein in a generic sense to refer to any type of computer code or set of computer-executable instructions that can be employed to program a computer or other processor to implement various aspects of the present disclosure as discussed above. Additionally, it should be appreciated that according to one aspect of this embodiment, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the embodiments described herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

The invention claimed is:

1. A self-contained soil stabilization system comprising:

a chassis;

at least one motor coupled to the chassis and configured to actuate a locomotion device configured to move the chassis;

a hopper disposed on the chassis and configured to contain a payload configured to stabilize soil;

a controller configured to transmit a hopper command to cause a portion of the payload to be deployed, wherein the controller is further configured to transmit a locomotion command to the at least one motor to move the chassis along a ground surface; and at least one sensor configured to sense a condition external to the system, and to provide an input to the controller in response to sensing the condition, wherein the controller is configured to automatically transmit the hopper command and/or the locomotion command based at least in part on the input.

2. A pile driving system comprising:

a chassis;

at least one locomotion device configured to move the chassis along a ground surface;

at least one motor coupled to the chassis and the at least one locomotion device, wherein the at least one motor is configured to actuate the at least one locomotor locomotion device to move the chassis along the ground surface;

a hopper disposed on the chassis and configured to contain one or more piles;

a controller configured to transmit a hopper command to the hopper to cause at least one of the one or more piles to be deployed, wherein the hopper is further configured to release at least one of the one or more piles in response to receiving the hopper command;

a gripper configured to retrieve the at least one pile from the hopper upon receipt of the hopper command; and a vibratory hammer configured to induce vibration in the gripper, wherein the controller is further configured to transmit a vibration command to the vibratory hammer to induce vibration in the gripper using the vibratory hammer.

3. The pile driving system of claim 2, wherein the vibratory hammer is disposed on the gripper.

4. The pile driving system of claim 2, wherein the at least one locomotion device comprises at least three wheels.

5. The pile driving system of claim 4, wherein each of the at least three wheels includes an independent suspension element which operatively couples the wheel to the chassis, and wherein the at least one motor comprises a first motor coupled to a first wheel of the at least three wheels and a second motor coupled to a second wheel of the at least three wheels.

6. The pile driving system of claim 5, wherein each of the independent suspension elements includes an actuator configured to adjust a distance between the wheel to which it is coupled and the chassis.

7. The pile driving system of claim 6, wherein the independent suspension element is configured to reduce the distance between the wheel to which it is coupled and the chassis when the gripper has grasped the deployed at least one pile so that at least 50% of the weight of the pile driving system is supported from the deployed at least one pile.

8. The pile driving system of claim 7, wherein the controller is configured to transmit a vibration command to the vibratory hammer to induce vibration in the gripper when the weight of the pile driving system is supported from the deployed at least one pile.

9. The pile driving system of claim 5, wherein the gripper is configured to grasp a previously deployed pile, and wherein the independent suspension element is configured to increase the distance between the wheel to which it is coupled and the chassis when the gripper has grasped the previously deployed pile to at least partially extract the previously deployed pile.

10. The pile driving system of claim 2, wherein the gripper is configured to grasp a first region of the deployed pile, wherein the controller is configured to transmit a vibration command to the vibratory hammer when the first region is grasped by the gripper, and wherein the gripper is further configured to release the first region after vibration has been induced in the gripper.

11. The pile driving system of claim 10, wherein the gripper is further configured to grasp a second region of the deployed pile after the first region is released, wherein the controller is configured to transmit a vibration command to the vibratory hammer when the second region is grasped by the gripper, and wherein the gripper is further configured to release the second region after vibration has been induced in the gripper.

12. A self-contained soil stabilization system comprising:

a chassis;

at least one wheel configured to support the chassis on a ground surface and to allow for locomotion of the chassis along the ground surface;

an independent suspension element operatively coupled to the at least one wheel to the chassis and configured to selectively adjust a distance between the at least one wheel and the chassis upon receipt of a suspension command;

at least one motor coupled to the chassis and the at least one wheel, wherein the at least one motor is configured to actuate the at least one wheel to move the chassis along the ground surface;

a hopper disposed on the chassis and configured to contain a payload for stabilizing soil; and a controller configured to transmit a suspension command to adjust the distance between the at least one wheel and the chassis and transmit a hopper command to cause a portion of the payload to be deployed, wherein the hopper is configured to deploy at least a portion of the payload in response to receiving the hopper command.

13. The self-contained soil stabilization system of claim 12, wherein the at least one wheel comprises at least three wheels, wherein each of the at least three wheels includes an independent suspension element configured to adjust the distance between the wheel to which it is coupled and the chassis.

14. The self-contained soil stabilization system of claim 13, wherein the independent suspension element includes an actuator configured to adjust the distance between the wheel to which it is coupled and the chassis.

15. The self-contained soil stabilization system of claim 12, wherein the controller is configured to transmit the suspension command to the independent suspension element to orient the chassis horizontal relative to a local gravity direction.

16. The self-contained soil stabilization system of claim 12, wherein the controller is configured to transmit the suspension command to the independent suspension element to reduce the distance between the wheel to which it is coupled and the chassis when the portion of the payload is deployed.

17. The self-contained soil stabilization system of claim 16, further comprising a gripper configured to grasp the portion of the payload from the hopper, wherein reducing the distance between the wheel and the chassis when the gripper has grasped the payload supports at least 50% of the weight of the self-contained soil stabilization system from the portion of the payload.

* * * * *